US007976793B2

(12) United States Patent
Solotareff et al.

(10) Patent No.: US 7,976,793 B2
(45) Date of Patent: Jul. 12, 2011

(54) ELECTRONIC PIPETTE

(75) Inventors: Stephane Solotareff, Wy Dit Joli Village (FR); Yves-Andre May, Versailles (FR); Christian Langlais, Ezanville (FR); Philippe Remy, Asnieres (FR); Patrick Haddad, Soisy sous Montmorency (FR)

(73) Assignee: Gilson S.A.S., Villiers-le-Bel (FR)

( * ) Notice: Subject to any disclaimer, the term of this patent is extended or adjusted under 35 U.S.C. 154(b) by 1121 days.

(21) Appl. No.: 10/944,532

(22) Filed: Sep. 17, 2004

(65) Prior Publication Data

US 2005/0118069 A1 Jun. 2, 2005

(30) Foreign Application Priority Data

| | | |
|---|---|---|
| Nov. 27, 2003 | (FR) | 03 13920 |
| Nov. 27, 2003 | (FR) | 03 13921 |
| Mar. 9, 2004 | (FR) | 04 02433 |
| Sep. 7, 2004 | (FR) | 04 09438 |
| Sep. 7, 2004 | (FR) | 04 09442 |
| Sep. 7, 2004 | (FR) | 04 09443 |

(51) Int. Cl.
*B01L 3/00* (2006.01)
*B01L 3/02* (2006.01)

(52) U.S. Cl. ..... 422/501; 422/509; 73/863.32; 73/864; 73/864.01; 73/864.11; 73/864.13

(58) Field of Classification Search ..... 422/501, 422/509; 73/863.32, 864, 864.01, 864.11, 73/864.13

See application file for complete search history.

(56) References Cited

U.S. PATENT DOCUMENTS

| | | | |
|---|---|---|---|
| 3,805,998 | A | 4/1974 | Croslin |
| 3,991,617 | A | 11/1976 | Marteau d'Autry |
| D252,823 | S | 9/1979 | Withers et al. |
| 4,362,064 | A | 12/1982 | Marteau d'Autry |

(Continued)

FOREIGN PATENT DOCUMENTS

| | | |
|---|---|---|
| CN | 1261694 | 8/2000 |

(Continued)

OTHER PUBLICATIONS

Partial International Search Report mailed Mar. 4, 2005 for PCT/IB2004/003859.

(Continued)

*Primary Examiner* — Brian R Gordon
(74) *Attorney, Agent, or Firm* — Foley & Lardner LLP

(57) ABSTRACT

A system controls aspiration and dispensation of a liquid in a pipette. The system includes a computing device and the pipette. The computing device includes a pipetting module and a first communication interface. The pipetting module defines an operation to perform at the pipette. The first communication interface sends electronic signals to the pipette, the electronic signals defining the operation to perform at the pipette. The pipette includes a sampling tube, a piston assembly, a piston drive mechanism, a second communication interface, and a microprocessor. The piston assembly mounts to the sampling tube and includes a piston rod that fits within the sampling tube. The piston drive mechanism includes a control rod having a surface that contacts the piston assembly. The piston drive mechanism moves the piston rod of the piston assembly within the sampling tube thereby causing regulation of a liquid in the sampling tube. The second communication interface receives the electronic signals from the computing device. The microprocessor controls the piston drive mechanism and performs the operation defined by the electronic signals.

17 Claims, 15 Drawing Sheets

U.S. PATENT DOCUMENTS

| | | | | |
|---|---|---|---|---|
| D279,710 | S | 7/1985 | Yonkers et al. | |
| 4,559,038 | A | 12/1985 | Berg et al. | |
| 4,567,780 | A | 2/1986 | Oppenlander et al. | |
| 4,586,546 | A | 5/1986 | Mezei et al. | |
| 4,633,413 | A | 12/1986 | Caveney et al. | |
| 4,671,123 | A | 6/1987 | Magnussen, Jr. et al. | |
| 4,779,467 | A | 10/1988 | Rainin et al. | |
| 4,780,833 | A | 10/1988 | Atake et al. | |
| 4,790,176 | A | 12/1988 | Marteau d'Autry | |
| 4,821,586 | A | 4/1989 | Scordato et al. | |
| 4,896,270 | A | 1/1990 | Kalmakis et al. | |
| 4,905,526 | A | 3/1990 | Magnussen, Jr. et al. | |
| 4,908,017 | A | 3/1990 | Howson et al. | |
| 5,018,394 | A | 5/1991 | Gilson | |
| 5,024,109 | A | 6/1991 | Romero et al. | |
| D325,974 | S | 5/1992 | Kalmakis et al. | |
| 5,187,990 | A | 2/1993 | Magnussen, Jr. et al. | |
| 5,473,344 | A | 12/1995 | Bacon et al. | |
| 5,477,508 | A | 12/1995 | Will | |
| 5,481,900 | A | 1/1996 | Husar | |
| 5,531,131 | A | 7/1996 | Sabloewski | |
| D375,798 | S | 11/1996 | Boothby | |
| 5,611,784 | A | 3/1997 | Barresi et al. | |
| 5,658,250 | A | 8/1997 | Blomquist et al. | |
| 5,662,612 | A | 9/1997 | Niehoff | |
| 5,779,984 | A | 7/1998 | Kelly et al. | |
| 5,808,558 | A | 9/1998 | Meek et al. | |
| 5,825,353 | A | 10/1998 | Will | |
| 5,835,732 | A | 11/1998 | Kikinis et al. | |
| 5,983,733 | A | 11/1999 | Strandberg et al. | |
| D419,685 | S | 1/2000 | Jacquet et al. | |
| 6,019,004 | A | 2/2000 | Conley et al. | |
| D426,642 | S | 6/2000 | Rainin et al. | |
| D426,643 | S | 6/2000 | Rainin et al. | |
| 6,090,348 | A | 7/2000 | Steele et al. | |
| 6,158,292 | A | 12/2000 | Gilson et al. | |
| D438,630 | S | 3/2001 | Honore | |
| 6,232,129 | B1 | 5/2001 | Wiktor | |
| 6,254,832 | B1 | 7/2001 | Rainin et al. | |
| 6,299,841 | B1 | 10/2001 | Rainin et al. | |
| 6,392,640 | B1 | 5/2002 | Will | |
| 6,428,750 | B1 | 8/2002 | Rainin et al. | |
| 6,459,422 | B1 * | 10/2002 | Kirk | 345/169 |
| 6,715,369 | B2 | 4/2004 | Baba et al. | |
| 6,734,881 | B1 | 5/2004 | Will | |
| 6,778,917 | B1 * | 8/2004 | Jansen | 702/45 |
| 6,841,129 | B2 | 1/2005 | Braun et al. | |
| 6,968,749 | B2 | 11/2005 | Chen et al. | |
| 2001/0043885 | A1 | 11/2001 | Wanner | |
| 2001/0055547 | A1 | 12/2001 | Rainin et al. | |
| 2002/0005075 | A1 * | 1/2002 | Kriz et al. | 73/864.18 |
| 2002/0089819 | A1 | 7/2002 | Misawa et al. | |
| 2002/0095240 | A1 | 7/2002 | Sickinger et al. | |
| 2002/0188410 | A1 | 12/2002 | Salje | |
| 2004/0166027 | A1 * | 8/2004 | Wilmer et al. | 422/100 |
| 2004/0171171 | A1 * | 9/2004 | Appoldt et al. | 436/180 |
| 2005/0255006 | A1 | 11/2005 | Romaguera | |
| 2007/0056351 | A1 * | 3/2007 | Curtis et al. | 73/1.74 |

FOREIGN PATENT DOCUMENTS

| | | |
|---|---|---|
| DE | 10118875 | 9/2002 |
| DE | 10205642 | 8/2003 |
| EP | 0337460 | 10/1989 |
| EP | 0724278 | 7/1996 |
| EP | 0864364 | 9/1998 |
| EP | 0999432 | 5/2000 |
| EP | 1 006 477 | 6/2000 |
| EP | 1006477 | 6/2000 |
| EP | 1250956 | 4/2002 |
| JP | 2002-099380 | 4/2002 |
| JP | 2006-537980 | 11/2002 |
| WO | WO 91/16974 | 11/1991 |
| WO | WO 97/02893 | 1/1997 |
| WO | WO 98/10265 | 3/1998 |
| WO | WO 00/51738 | 9/2000 |
| WO | WO 02/00346 | 1/2002 |
| WO | WO 02/090895 | 11/2002 |
| WO | WO 2004/020096 | 3/2004 |

OTHER PUBLICATIONS

International Search Report mailed Mar. 10, 2005 for PCT/IB2004/003876.

International Search Report mailed May 5, 2005 for PCT/IB2004/003859.

Eisele, "Preparation of Protein Crystallization Buffers with a Computer-Controlled Motorized Pipette: PIPEX," J. Appl. Cryst., vol. 26, 1993, pp. 92-96.

Brochure for Rainin EDP Plus Motorized Microliter Pipette, Rainin Instrument Co., Inc., 1989.

The first Office Action issued in Russian Application No. 2006122511 dispatched on May 29, 2008.

First Office Action issued in Chinese Application No. 200480035132.2 dispatched on Jun. 27, 2008.

Second Examination Communication in European Application No. 04798968.6 dispatched on Aug. 13, 2008.

European Communication for EP Application No. 04798982.7 dated Feb. 27, 2009.

European Search Report for EP No. 04 29 2808 dated Feb. 23, 2005.

European Search Report for EP No. 04 29 2807 dated Apr. 13, 2005.

European Search Report for EP No. 04 29 2809 dated Feb. 23, 2005.

European Search Opinion and Report for EP Application No. 05291795.2 dated Nov. 18, 2005.

European Search Opinion and Report for EP Application No. 05291853.9 dated Nov. 24, 2005.

Australian Examiner's Report for Australian Application No. 2004293955 dated Jun. 12, 2009.

Preliminary conclusion of the qualification examination for Ukrainian Patent Application No. 2006 07108 mailed Nov. 23, 2009 (with English translation).

Notification of Grounds of Refusal for Japanese Patent Application No. 2006-540665 mailed Feb. 22, 2010 (with English translation).

Non-Final Office Action for U.S. Appl. No. 10/580,725 mailed Jan. 21, 2010.

Final Notification of Reasons for Rejection issued in Japanese Patent Application No. 2006-540665 and dispatched Aug. 23, 2010.

Internet information from http://www.brandtech.com/test/ffpesc/tfpesc.shtml, printed Sep. 2, 2004.

Internet information from http://www.rainin.com, printed Sep. 2, 2004.

Internet information from http://www.rainin-global.com, printed Sep. 2, 2004.

Internet information from http://www.eandkscientific.com, printed Sep. 2, 2004.

First Examination Report issued in Indian Patent Application No. 2349/CHENP/2006 and dated Mar. 14, 2011.

Office Action issued in European Patent Application No. 04 798 968.6 and dated Apr. 7, 2011.

* cited by examiner

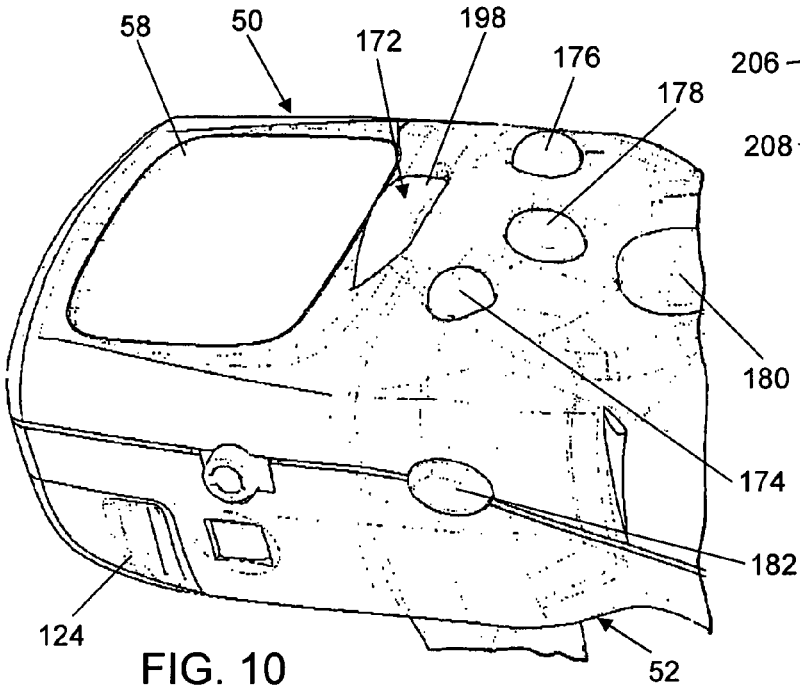
FIG. 10
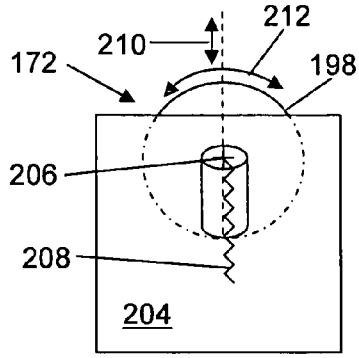
FIG. 12
FIG. 11
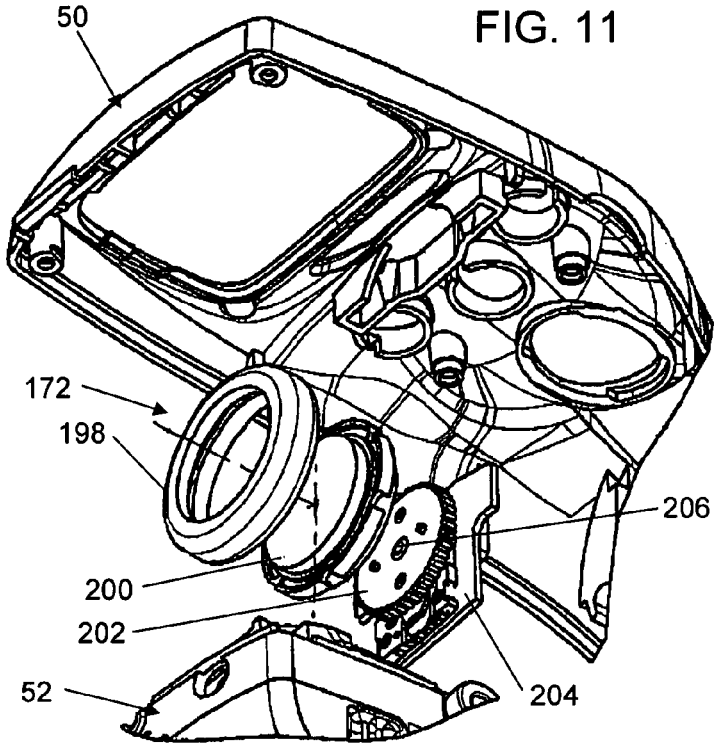

| Previous | | Current | |
|---|---|---|---|
| Signal A | Signal B | Signal A | Signal B |
| 1 | 1 | 0 | 1 |
| 0 | 1 | 0 | 0 |
| 0 | 0 | 1 | 0 |
| 1 | 0 | 1 | 1 |

| Previous | | Current | |
|---|---|---|---|
| Signal A | Signal B | Signal A | Signal B |
| 1 | 1 | 1 | 0 |
| 1 | 0 | 0 | 0 |
| 0 | 0 | 0 | 1 |
| 0 | 1 | 1 | 1 |

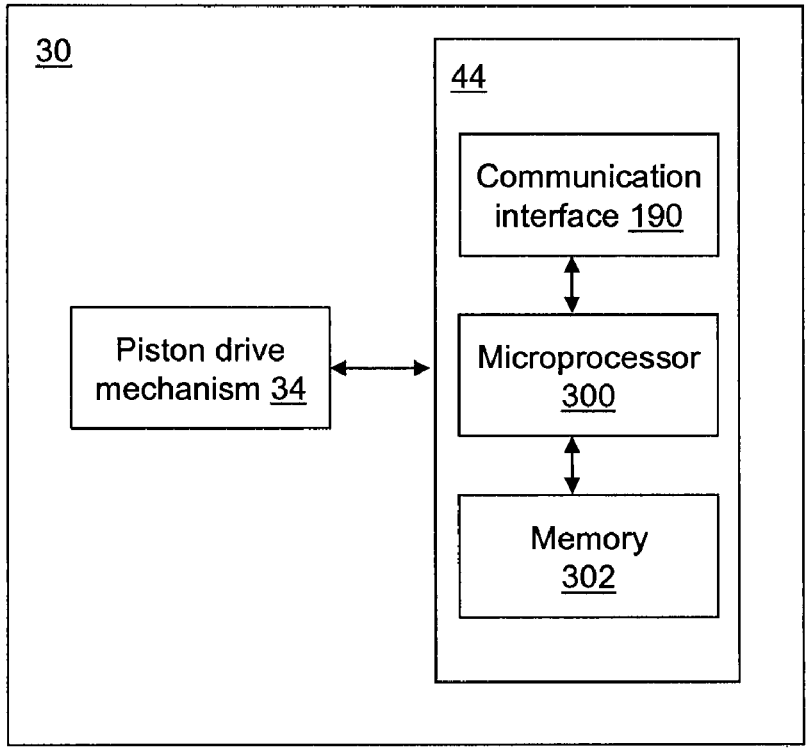
Fig. 21
Fig. 22
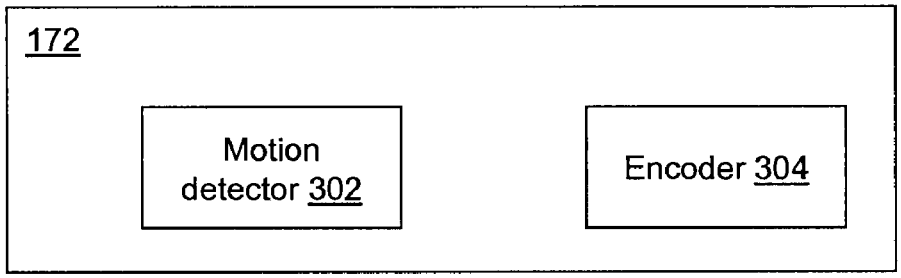

ELECTRONIC PIPETTE

FIELD OF THE INVENTION

The present invention is related generally to a pipette for aspirating and for dispensing adjustable volumes of liquid. More specifically, the present invention relates to a programmable electronic pipette providing multiple modes of operation.

BACKGROUND OF THE INVENTION

In pharmaceutical, genomic, and proteomic research, biology research, drug development laboratories, and other biotechnology applications, a liquid pipette is used to handle laboratory samples in a variety of laboratory procedures. Using a pipette, a volume of liquid is aspirated into the pipette. The volume of liquid may then be dispensed in one or more dispensation volume. A piston drive mechanism controls the aspiration and the dispensation of the liquid in specified volumes by imparting motion to a piston assembly. Pipettes in which the piston assembly within the body of the pipette includes a piston rod controlled by either a motor or directly by the user are known to those skilled in the art. Motion of the piston rod is controlled by a thrust exerted by the piston drive mechanism. However, angular displacement of components within the piston drive mechanism may occur relative to the piston assembly. The displacement often causes a small, but measurable longitudinal shift of the piston drive mechanism that in turn causes an inaccurate aspiration or dispensation of the volume of liquid. Thus, what is needed, is a pipette that eliminates the unwanted longitudinal displacement of the piston drive mechanism components.

A pipette may operate in a manual mode wherein the user manually controls the speed and the volume of aspiration or of dispensation of the liquid using a pressure sensitive knob. Alternatively, a pipette may operate in an electronic mode wherein a motor controls the aspiration and/or dispensation of the liquid. The user may select various parameters including a speed, a volume, a number of aspirations, a number of dispensations, etc. using a user interface. The user interface may include a numeric keypad that allows the user to enter, for example, the volume. A pipette generally is small and lightweight because the desire is for an easily portable device that fits comfortably into a hand of the user and that can be used repetitively with a single hand. As a result, the display and the operational controls must be small making them generally tedious to use. For example, some pipettes may have the small numeric keypad, while the input to other pipettes may be through a set of buttons such as up and down arrow buttons to increase or to decrease a parameter. However, the numeric keypad is difficult to use because each numerical button is small and difficult to select particularly when a user is wearing gloves. Also, use of the keypad buttons generally requires the use of both hands. One hand to support the device and the other hand to precisely select the appropriate numerical button. Additionally, the user may need to successively dispense widely-differing volumes. The up and down arrow buttons require a large number of depressions to reach, for example, the widely-differing volume amount. Thus, what is needed is a pipette having an input interface that simplifies the selection of operational parameters for the device and that reduces the time required to change settings within the device. What is further needed is an input interface that can be operated using a single hand.

Electronic pipettes typically are controlled by small microprocessors placed within the housing of the pipette. As electronic pipettes have become more sophisticated, additional and more complex operational modes may be provided. For example, an electronic pipette may be configured to aspirate a volume of liquid and dispense the volume in successive dispensation cycles. Additionally, an electronic pipette may be configured to repeatedly aspirate and dispense a volume of liquid thereby mixing the liquid before the final dispensation of the liquid. To add additional complexity, a sequence of modes may be provided to execute in succession. Again, however, the display and the operational controls are small and tedious to use making it more difficult to "program" the electronic pipette to perform a complex sequence of operations. Thus, what is needed is a pipette that can interface with an external computing device. What is further needed is an application that can be executed on the external computing device to provide an easy to use interface to the user and to provide instructions to the pipette for operation in a "programmed" mode.

SUMMARY OF THE INVENTION

An exemplary embodiment of the invention relates to a method of using a user interface presented in a display of a device. The method includes, but is not limited to, moving between a plurality of items by imparting rotational motion to a disc mounted in a first plane of a device, the plurality of items presented in a display of the device, and selecting an item from the plurality of items by imparting translational motion to the disc in the first plane. The method may further include modifying the item by imparting rotational motion to the disc in the first plane and setting the modified item by imparting translational motion to the disc in the first plane.

Another exemplary embodiment of the invention relates to a method of responding to user inputs to a user interface presented in a display of a device. The method includes, but is not limited to, receiving a first signal indicating movement between a plurality of items wherein the first signal is generated by imparting rotational motion to a disc mounted in a first plane of a device, the plurality of items presented in a display of the device, and receiving a second signal indicating selection of an item from the plurality of items wherein the second signal is generated by imparting translational motion to the disc in the first plane. The method may further include receiving a third signal indicating modification of the item wherein the third signal is generated by imparting rotational motion to the disc in the first plane and receiving a fourth signal indicating that the modified item should be set in the device wherein the fourth signal is generated by imparting translational motion to the disc in the first plane.

Still another exemplary embodiment of the invention relates to a device for using a user interface presented in a display of the device. The device includes, but is not limited to, an axle, a disc, an encoder, a motion detector, a display, and a microprocessor. The disc mounts to the axle in a manner allowing rotation of the disc about the axle in a plane of the device, the disc translatable in the plane of the device. The encoder is configured to generate a first electrical signal indicating a first rotation of the disc about the axle, the first rotation in the plane of the device. The motion detector is configured to generate a second electrical signal indicating a first translation of the disc in the plane of the device. The microprocessor couples to the display and is configured to receive the first electrical signal, wherein the first rotation of the disc indicates movement between a plurality of items presented in the display, and to receive the second electrical signal, wherein the first translation of the disc indicates selection of an item from the plurality of items presented in the display.

Still another exemplary embodiment of the invention relates to a device for aspirating and for dispensing liquid. The device includes, but is not limited to, a thumb wheel, a display, a sampling tube, and a microprocessor. The thumb wheel includes, but is not limited to, an axle, a disc, an encoder, and a motion detector. The disc mounts to the axle in a manner allowing rotation of the disc about the axle in a plane of the device, the disc translatable in the plane of the device. The encoder is configured to generate a first electrical signal indicating rotation of the disc about the axle, the rotation in the plane of the device. The motion detector is configured to generate a second electrical signal indicating translation of the disc in the plane of the device. The sampling tube has an assembly for holding a liquid. The microprocessor couples to the display and is configured to regulate the liquid in the sampling tube, to receive the first electrical signal, wherein the rotation of the disc indicates movement between a plurality of items presented in the display, and to receive the second electrical signal, wherein the translation of the disc indicates selection of an item from the plurality of items presented in the display.

Still another exemplary embodiment of the invention relates to a device for aspirating and for dispensing liquid. The device includes, but is not limited to, a sampling tube, a piston assembly, and a piston drive mechanism. The piston assembly mounts to the sampling tube and includes, but is not limited to, a piston rod that fits within the sampling tube. The piston drive mechanism includes, but is not limited to, a control rod having a surface that contacts the piston assembly. The piston drive mechanism is configured to move the piston rod of the piston assembly within the sampling tube thereby causing regulation of a liquid in the sampling tube. The surface of the control rod is a non-flat surface.

Still another exemplary embodiment of the invention relates to a method of controlling a pipette. The method includes, but is not limited to, receiving at a communication interface of a pipette electronic signals from a computing device, wherein the computing device is not integral with the pipette and performing an operation at the pipette in response to the received electronic signals.

Still another exemplary embodiment of the invention relates to a device for aspirating and for dispensing liquid. The device includes, but is not limited to, a sampling tube, a piston assembly, a piston drive mechanism, a communication interface, and a microprocessor. The piston assembly mounts to the sampling tube and includes, but is not limited to, a piston rod that fits within the sampling tube. The piston drive mechanism includes, but is not limited to, a control rod having a surface that contacts the piston assembly. The piston drive mechanism is configured to move the piston rod of the piston assembly within the sampling tube thereby causing regulation of a liquid in the sampling tube. The communication interface is configured to receive electronic signals from a computing device, wherein the computing device is not integral with the device. The microprocessor is configured to control the piston drive mechanism and to perform an operation in response to the received electronic signals.

Still another exemplary embodiment of the invention relates to a system for controlling aspiration and dispensation of a liquid in a pipette. The system includes, but is not limited to, a computing device and a pipette. The computing device includes, but is not limited to, a pipetting module and a first communication interface. The pipetting module includes, but is not limited to, computer code configured to define an operation to perform at a pipette. The first communication interface is configured to send electronic signals to the pipette, the electronic signals defining the operation to perform at the pipette. The pipette includes, but is not limited to, a sampling tube, a piston assembly, a piston drive mechanism, a second communication interface, and a microprocessor. The piston assembly mounts to the sampling tube and includes, but is not limited to, a piston rod that fits within the sampling tube. The piston drive mechanism includes, but is not limited to, a control rod having a surface that contacts the piston assembly. The piston drive mechanism is configured to move the piston rod of the piston assembly within the sampling tube thereby causing regulation of a liquid in the sampling tube. The second communication interface is configured to receive the electronic signals from the computing device. The microprocessor couples to the second communication interface and is configured to control the piston drive mechanism and to perform the operation defined by the electronic signals.

Other principal features and advantages of the invention will become apparent to those skilled in the art upon review of the following drawings, the detailed description, and the appended claims.

BRIEF DESCRIPTION OF THE DRAWINGS

The preferred embodiments will hereafter be described with reference to the accompanying drawings, wherein like numerals will denote like elements.

FIG. 10 is a first perspective view of user controls of the electronic pipette in accordance with an exemplary embodiment.

FIG. 11 is an exploded view of a thumb wheel of the user controls of the electronic pipette in accordance with an exemplary embodiment.

FIG. 12 is a view of the thumb wheel of the user interface of the electronic pipette in accordance with an exemplary embodiment.

FIG. 21 is a block diagram of a pipette in accordance with an exemplary embodiment.

FIG. 22 is a block diagram of a thumb wheel in accordance with an exemplary embodiment.

DETAILED DESCRIPTION OF THE PREFERRED EMBODIMENTS

Figure 1:
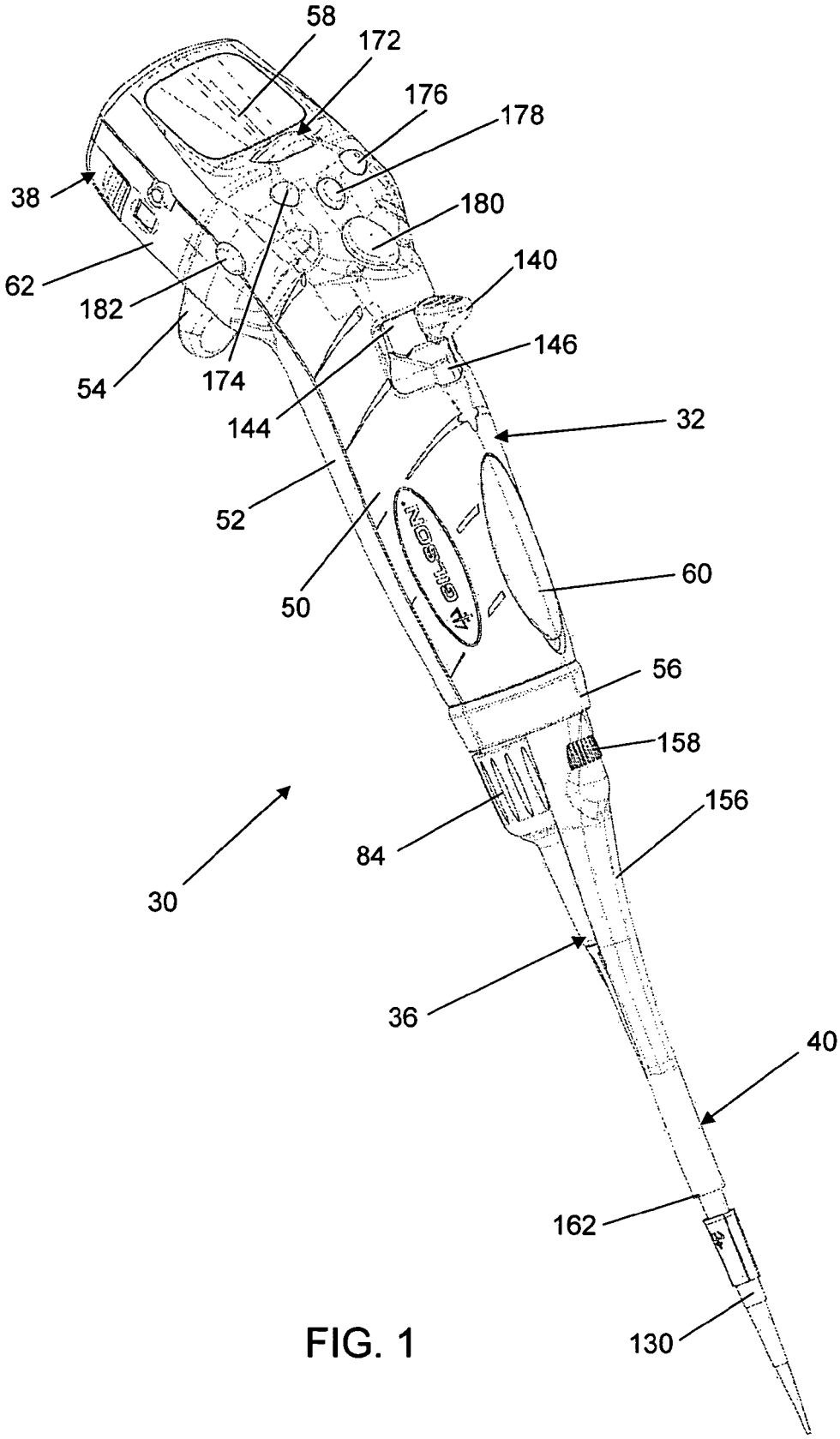
FIG. 1 is a perspective view of an electronic pipette in accordance with an exemplary embodiment.

With reference to the exemplary embodiment of FIG. 1, an electronic pipette 30 may include one or more sampling tube 36 that accommodates various amounts of liquid. The electronic pipette 30 can be commanded to automatically aspirate and dispense a succession of liquid volumes into the one or more sampling tube 36. The electronic pipette 30 includes a number of components and subsystems that together provide various operational modes for aspirating and dispensing liquids in precise volumes. The components and subsystems, shown with reference to the exemplary embodiment of FIGS. 2 and 3, may include, but are not limited to, a body case 32, a piston drive mechanism 34, a piston assembly 35, the sampling tube 36, an internal power subsystem 38, an external tip ejection mechanism 40, an internal tip ejection mechanism 42, and a control electronics card 44. Some of these components and subsystems are known to those skilled in the art, and thus, will not be discussed in significant detail herein. The internal power subsystem 38 may comprise a battery 120, a connector 122, and a battery case 124. The battery case 124 holds the battery 120 and fits into the body case 32. The battery may provide power for example, to the piston drive mechanism 34 and/or the control electronics card 44. The connector 122 provides the electrical connection to the control electronics card 44.

Figure 4:
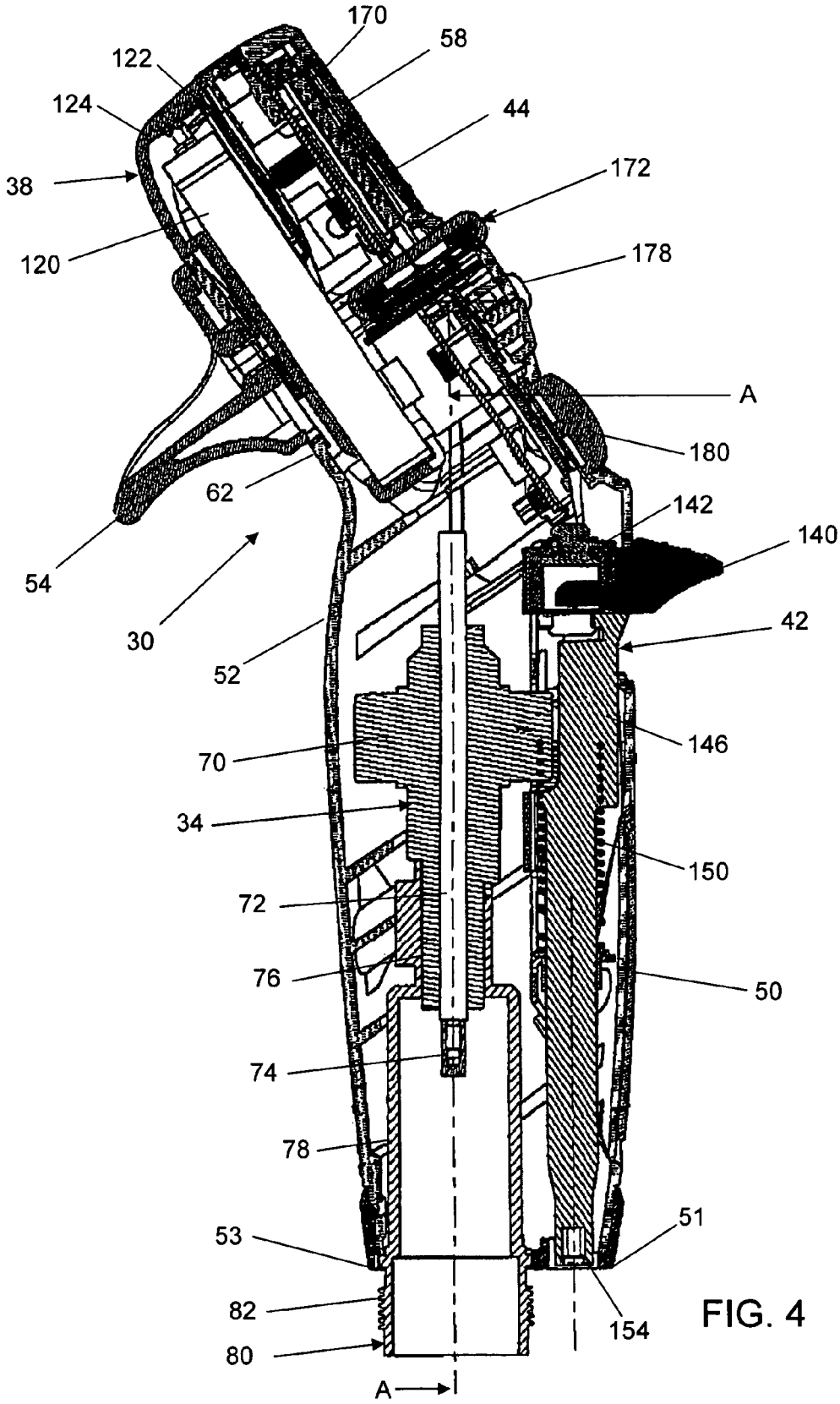
FIG. 4 is a cross sectional view of the electronic pipette of FIG. 1.
Figure 5:
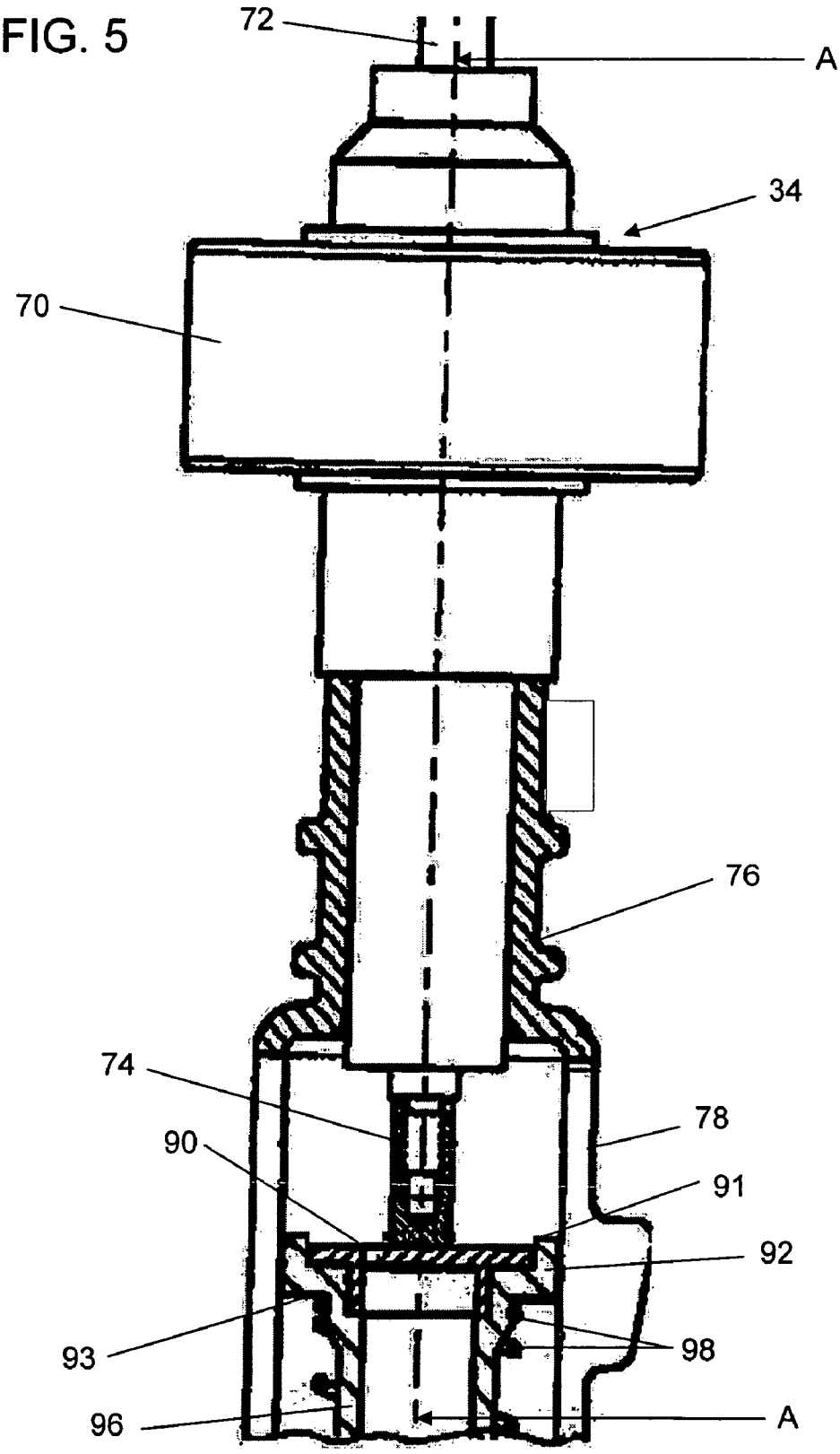
FIG. 5 is a first cross sectional view of a piston drive mechanism of the electronic pipette in accordance with an exemplary embodiment.

The body case 32 provides a comfortable external cover for a user holding the pipette 30 and protects the components of the pipette 30. The body case 32 includes, but is not limited to, a front case 50, a rear case 52, a finger rest 54, a case connection guide 56, a display cover 58, and a customization cover 60. The front case 50 fits with the rear case 52 to enclose the piston drive mechanism 34, the piston assembly 35, the internal tip ejection mechanism 42, and the control electronics card 44. The finger rest 54 provides a bracing point, for example, for the pipette user's index finger to rest against while holding the body of the pipette 30 in the palm of the hand and while using the pipette 30 user controls with the thumb of the same hand. The pipette 30 provides operation with either a left or a right hand of the user. One or more screw 55 or other attachment device may mount the finger rest 54 to an upper portion 62 of the rear case 52. As used in this disclosure, the term "mount" includes join, unite, connect, associate, insert, hang, hold, affix, attach, fasten, bind, paste, secure, bolt, screw, rivet, solder, weld, and other like terms. The upper portion 62 of the rear case 52 may tilt away from a user looking at the display cover 58 and holding the pipette 30 upright along a longitudinal axis A-A depicted in FIG. 4. Tilting away from the user provides a more comfortable fit of the pipette 30 in the hand of the user and an improved viewing angle to the display cover 58.

The finger rest 54 may slidably mount to the rear case 52 allowing the user to comfortably position the finger rest 54 based on the size of the user's hand. The case connection guide 56 slides over an end 51 of the front case 50 and an end 53 of the rear case 52 to mount the front case 50 to the rear case 52. One or more screw 57 may removably mount the case connection guide 56 to the front case 50 and/or the rear case 52 to allow disassembly and reassembly of the pipette 30. The display cover 58 may be formed of plastic, glass, or other suitably transparent material that protects a display 170 of the control electronics card 44. The customization cover 60 may be formed of plastic, glass, or other suitably transparent material that protects a customization sheet 64 used to allow quick identification of the pipette 30.

The piston drive mechanism 34 causes the aspiration and dispensation of a specified volume of liquid through the sampling tube 36 by moving a piston rod 94 within the piston assembly 35 along the longitudinal axis A-A within the sampling tube 36. Motion of the piston produces an air displacement that aspirates or dispense the liquid into or out of the sampling tube 36. The piston drive mechanism may be manually controlled by a user, for example, through depression of a knob or may be controlled using a motor. With reference to the exemplary embodiment of FIGS. 2-5, the piston drive mechanism 34 may include, but is not limited to, an actuator 70, a control rod 72, a control rod tip 74, a control rod support 76, a housing 78, and a sampling tube attachment knob 80. The piston drive mechanism 34 may be removably mounted within the body case 32 of the pipette 30 such that the control rod 72 extends along the longitudinal axis A-A. In an exemplary embodiment, the sampling tube attachment knob 80 may mount to the body case 32.

The actuator 70 may be a power controlled motor for moving the control rod 72 under the control of a microprocessor 300 (shown with reference to FIG. 21) mounted to the control electronics card 44. The actuator 70 may be implemented using a variety of electromechanical devices as known to those skilled in the art. The actuator 70 precisely moves the control rod 72 up and down the longitudinal axis A-A to aspirate or to dispense liquid into or out of the sampling tube 36. The actuator 70 interfaces with the microprocessor 300 of the control electronics card 44 from which the actuator 70 receives electrical signals for controlling the control rod 72 displacement. The control electronics card 44 may include one or more connector or interface for communicating with the actuator 70. The control rod tip 74 mounts to an end of the control rod 72 opposite the actuator 70. For example, the control rod tip 74 may screw onto or into the control rod 72. The control rod support 76 maintains the control rod 72 displacement along the longitudinal axis A-A. The housing 78 mounts to the control rod support 76 and encloses the portion of the control rod 72 and the control rod tip 74 that extend beyond the control rod support 76. Thus, for example, the housing 78 may form a socket.

The tube attachment knob 80 extends from an end of the housing 78 opposite the control rod support 76. The tube attachment knob 80 includes an exterior surface 82 that may be threaded. A tube attachment nut 84 may include an interior surface that fits over the tube attachment knob 80 thereby removably connecting the sampling tube 36 to the body case 32 of the pipette 30 as shown with reference to FIGS. 1 and 3. The interior surface of the tube attachment nut 84 may also be threaded to engage with the exterior surface 82 of the tube attachment knob 80.

Figure 2:
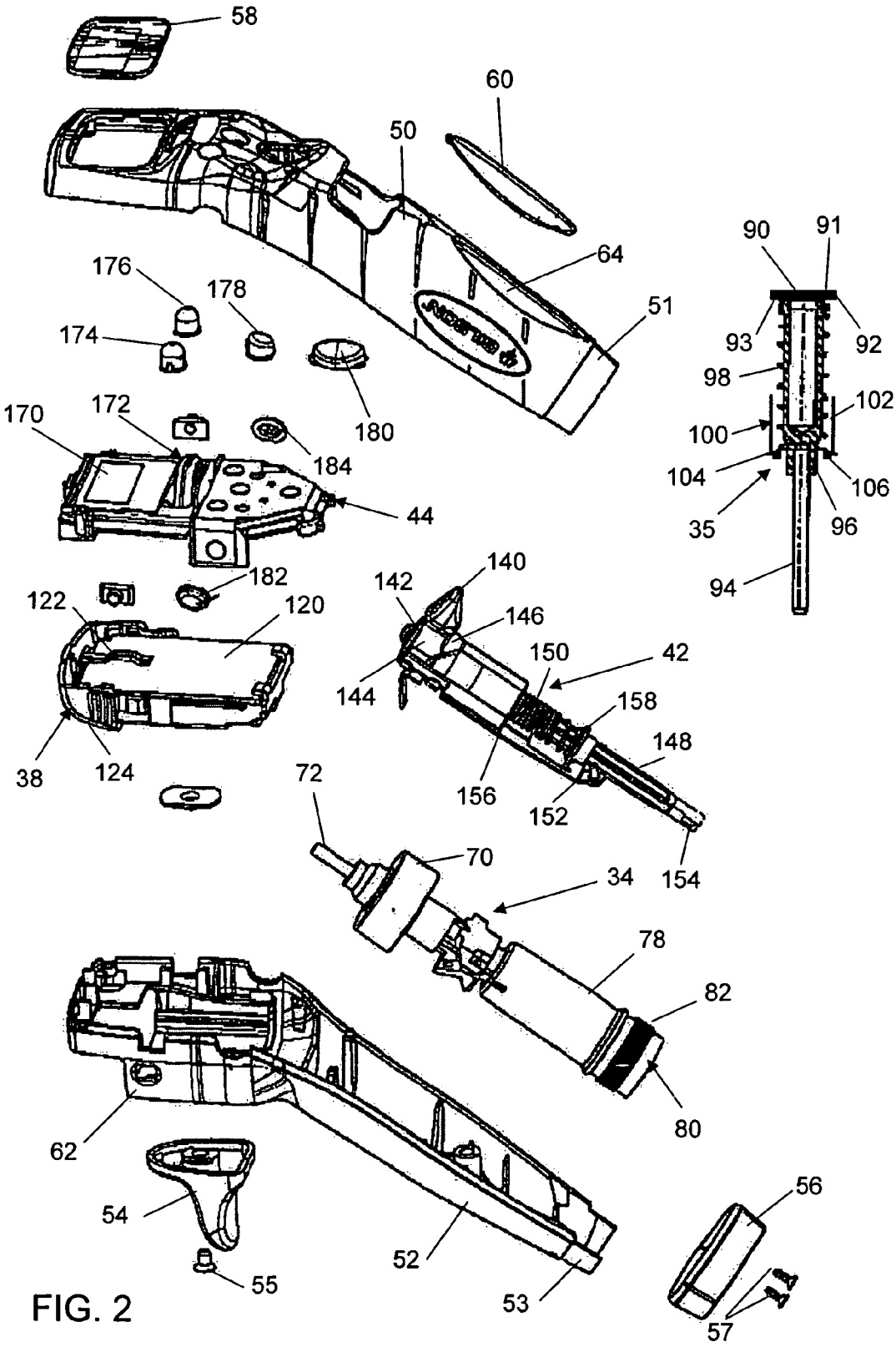
FIG. 2 is a first exploded view of the electronic pipette of FIG. 1.
Figure 3:
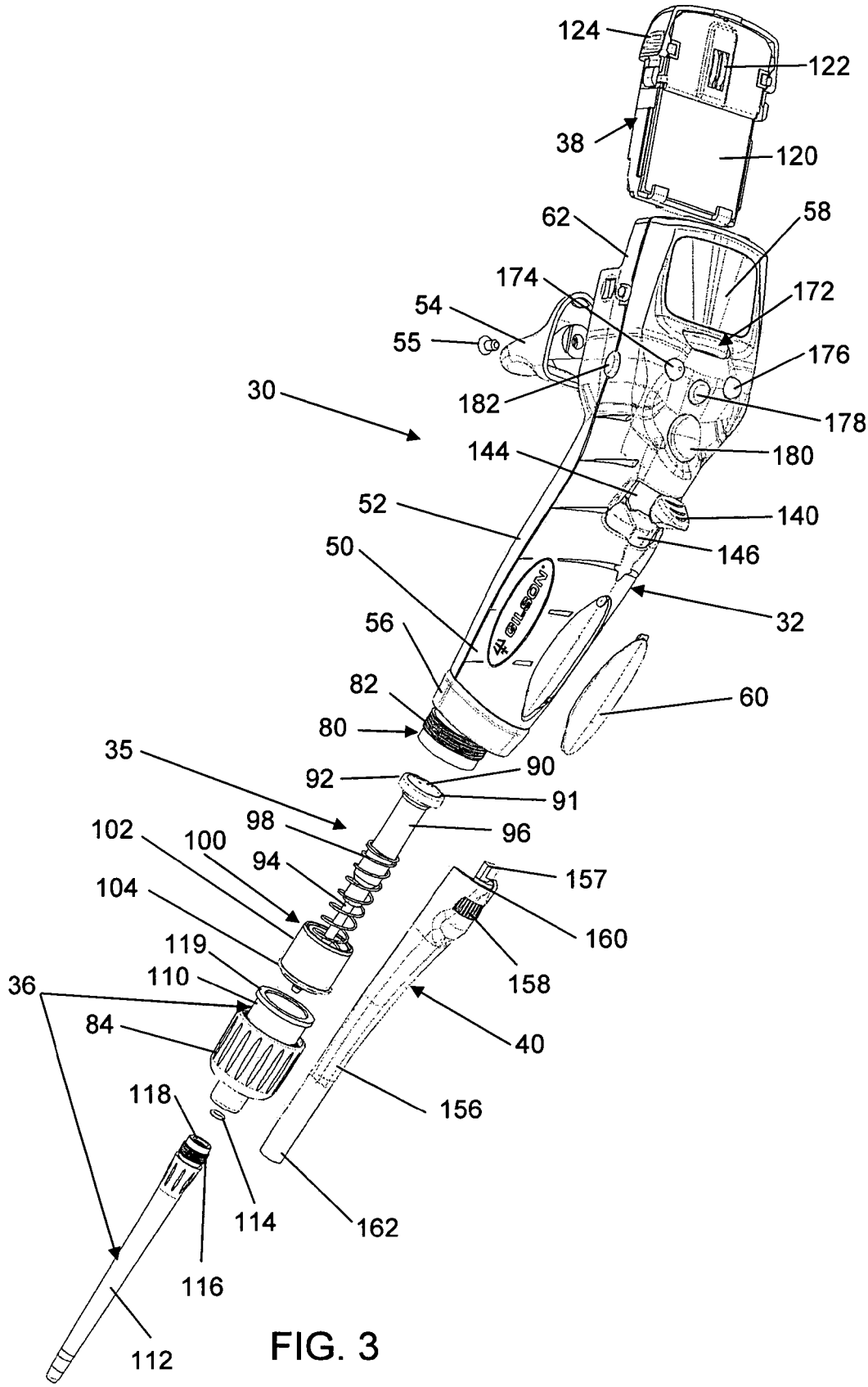
FIG. 3 is a second exploded view of the electronic pipette of FIG. 1.

With reference to the exemplary embodiment of FIG. 3, the piston assembly 35 includes, but is not limited to, a piston contact plate 90, a piston head 92, the piston rod 94, a piston housing 96, a piston return spring 98, and a spring guide 100. The piston contact plate 90 may be formed of metallic or plastic material. In an exemplary embodiment, the piston contact plate 90 is formed of metallic material. The piston head 92 may be a circular disk formed of metallic or plastic material. The piston head 92 has a first face 91 and a second face 93 that faces in a direction opposite the first face 91. The piston contact plate 90 mounts to the first face 91 of the piston head 92 as shown with reference to FIGS. 2 and 3. The piston rod 94 mounts to the second face 93 of the piston head 92 and extends in a generally perpendicular direction from the second face 93 of the piston head 92 in a direction opposite the first face 91. The piston rod 94 has a generally cylindrical shape. The piston rod 94 may be formed of metallic or plastic material. In an exemplary embodiment, the piston rod 94 is formed of metallic material.

The piston housing 96 mounts to the second face 93 of the piston head 92 and extends in a generally perpendicular direction from the second face 93 of the piston head 92 and encloses the piston rod 94. The piston housing 96 may be formed of metallic or plastic material. In an exemplary embodiment, the piston housing 96 is formed of plastic material. The piston housing 96 has a generally cylindrical shape and may include one or more tapered section as shown with reference to FIG. 3. The piston return spring 98 mounts to the piston housing 96 adjacent the second face 93 of the piston head 92 and extends generally perpendicular to the second face 93 of the piston head 92 along the longitudinal axis A-A. In an exemplary embodiment, the piston return spring 98 slides over the piston housing 96 and is held in place by friction forces between the piston return spring 98 and a section of the piston housing 96 adjacent the second face 93 of the piston head 92.

The spring guide 100 may include a hollow cylindrical body 102, a rim 104, and a guide ring 106. The rim 104 mounts to one end of the hollow cylindrical body 102 and extends from the hollow cylindrical body 102 in a generally perpendicular direction away from a center of the hollow cylindrical body 102. The guide ring 106 mounts to the rim 104 opposite the hollow cylindrical body 102. The guide ring 106 has a smaller inner circumference than the hollow cylindrical body 102. The piston housing 96 and the piston return spring 98 fit within the hollow cylindrical body 102 as shown with reference to the exemplary embodiment of FIG. 3. In assembling the pipette 30, the hollow cylindrical body 102 of the spring guide 100 slides over the piston housing 96 and the piston return spring 98 until the piston return spring 98 presses against the guide ring 106 of the spring guide 100 as shown with reference to FIG. 2. The piston assembly 35 slides into the housing 78 of the piston drive mechanism as shown with reference to FIG. 5.

As shown with reference to the exemplary embodiment of FIG. 3, the sampling tube 36 includes, but is not limited to, an upper tube 110, a lower tube 112, and an O-ring 114. The lower tube 112 mounts to the upper tube 110. For example, the lower tube 112 may include a threaded end 116 that screws into a complementarily threaded surface of the upper tube 110. The upper tube 110 and the lower tube 112 may include one or more tapered section. The O-ring 114 is positioned in an undercut 118 located between the upper tube 110 and the lower tube 112. The O-ring 114 provides a watertight connection between the piston rod 94 and the lower tube 112. An end 119 of the upper tube 110 may fit against the rim 104 of the spring guide 100. The guide ring 106 of the spring guide 100 may fit within the opening of the upper tube 110 formed at the end 119. The tube attachment nut 84 slides over the sampling tube 36 that presses against the piston assembly 35 thereby immobilizing the sampling tube 36 relative to the body case 32 and the piston drive mechanism 34 as shown with reference to FIG. 6.

Figure 6:
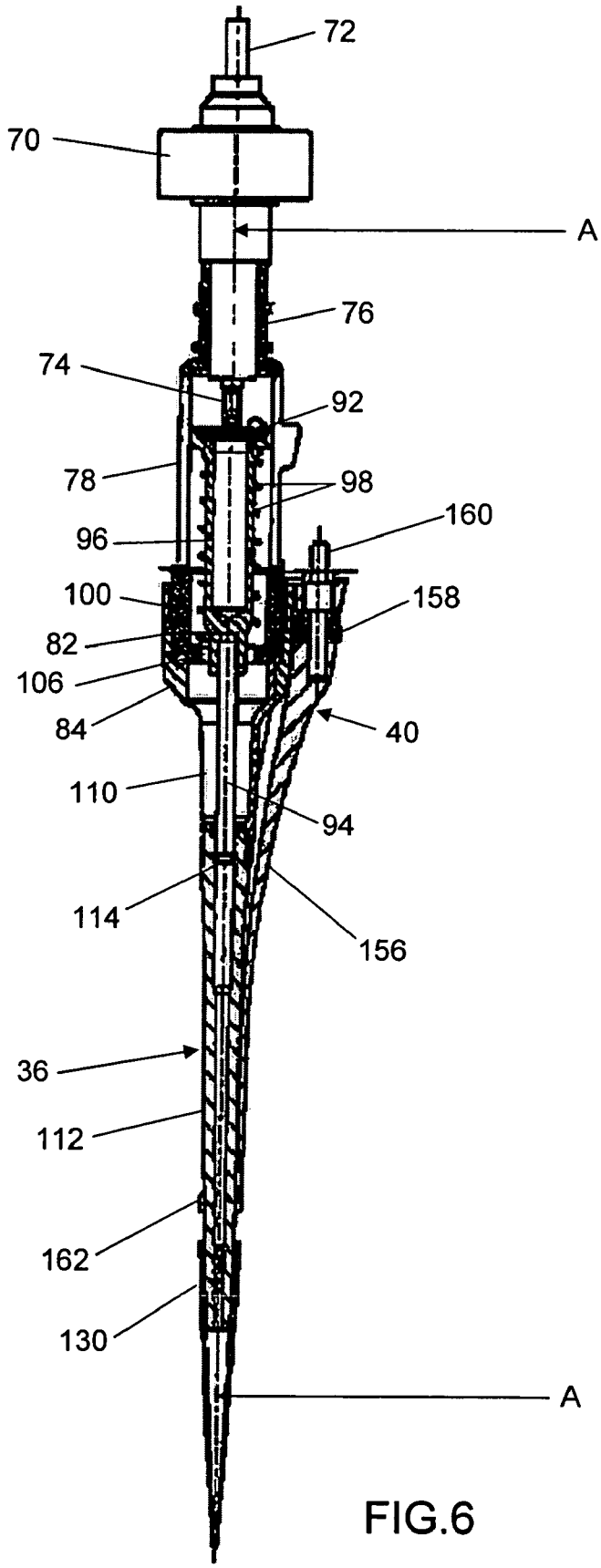
FIG. 6 is a cross sectional view of the piston drive mechanism, a piston assembly, a sampling tube, and an external tip ejection mechanism of the electronic pipette in accordance with an exemplary embodiment.

With reference to the exemplary embodiment of FIG. 6 a cross section of the piston drive mechanism 34, the piston assembly 35, the sampling tube 36, and the external tip ejection mechanism 40 mounted for aspiration and dispensation of liquid by the user is shown. The control rod tip 74 contacts the piston contact plate 90 of the piston assembly 35 within the housing 78 of the piston drive mechanism 34. When dispensing liquid, the piston drive mechanism 34, through displacement of the control rod tip 74 along the longitudinal axis A-A, pushes the piston assembly 35 away from the piston drive mechanism 34 at the point where the control rod tip 74 contacts the piston contact plate 90. The piston return spring 98 compresses against the spring guide 100 held in place by the tube attachment nut 84. When aspirating liquid, the piston drive mechanism 34 moves the control rod tip 74 toward the piston drive mechanism 34. Despite this displacement, the piston contact plate 90 remains in contact with the control rod tip 74 as a result of the compressive force of the piston return spring 98.

Figure 7:
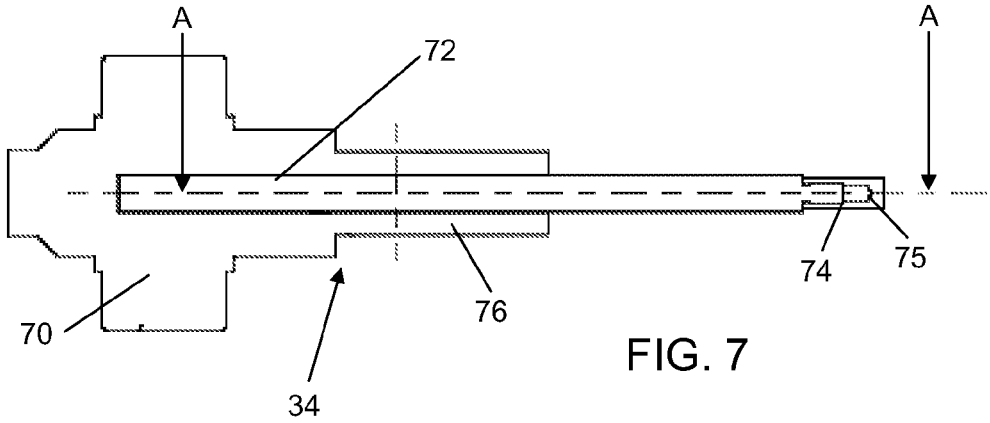
FIG. 7 is a second cross sectional view of the piston drive mechanism of the electronic pipette in accordance with an exemplary embodiment.
Figure 8:
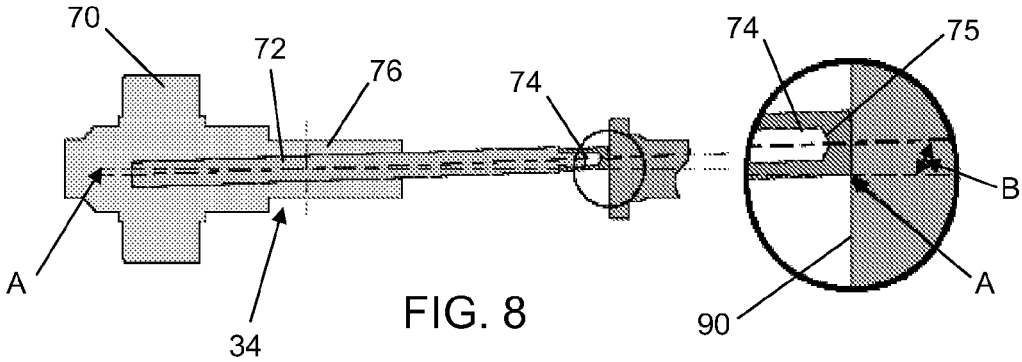
FIG. 8 is a first cross sectional view of the piston drive mechanism approaching the piston assembly in accordance with an exemplary embodiment.
Figure 9:
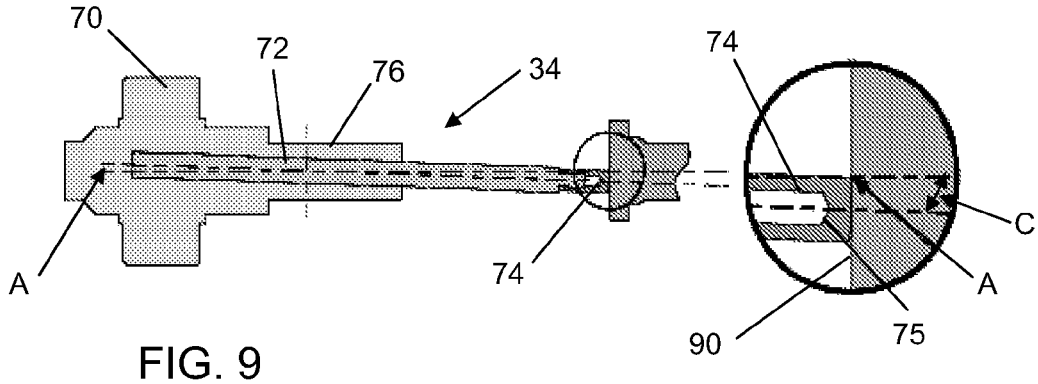
FIG. 9 is a second cross sectional view of the piston drive mechanism approaching the piston assembly in accordance with an exemplary embodiment.
Figure 8A:
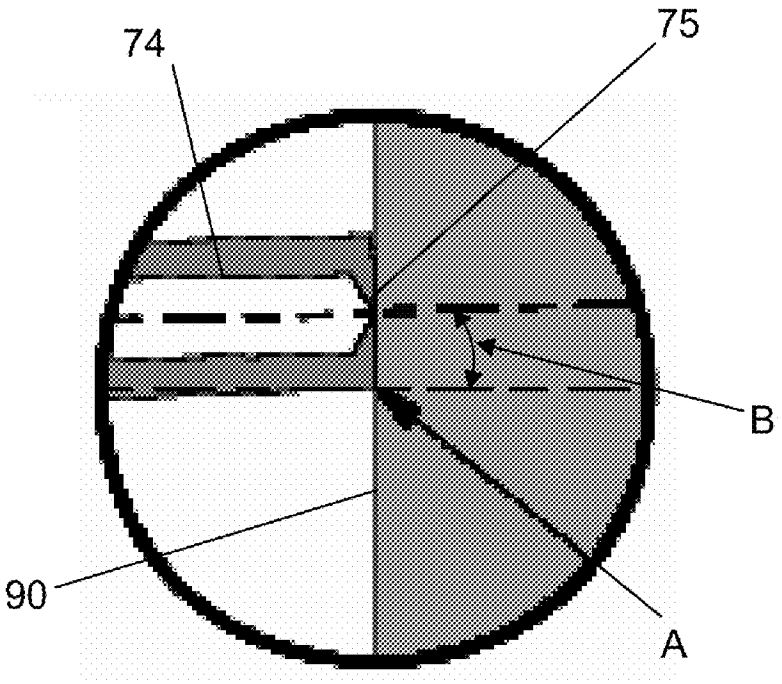
FIG. 8*a* is an exploded view of the first cross sectional view of FIG. 8 with the piston drive mechanism in contact with the piston assembly in accordance with an exemplary embodiment.

With reference to the exemplary embodiment of FIG. 7, the control rod tip 74 has a contact surface 75 that contacts the piston contact plate 90 as shown with reference to FIG. 8*a*. An angular displacement may result depending on where the contact surface 75 of the control rod tip 74 contacts the piston contact plate 90. With reference to FIG. 7, the ideal alignment of the piston drive mechanism 34 is shown. With reference to FIGS. 8 and 9, an example misalignment of the piston drive mechanism 34 is shown including an angular displacement B and an angular displacement C relative to the ideal alignment along the longitudinal axis A-A. If the contact surface 75 is flat, the angular displacement may effect the precision of the pipette 30 by changing the distance along the longitudinal axis A-A that the control rod 72 extends before contacting the contact plate 90, and thus, the volume of liquid that is aspirated or dispensed. Using a non-flat surface for the contact surface 75 of the control rod tip 74 maintains the correct distance along the longitudinal axis A-A, thereby reducing inaccuracy in the pipette aspiration or dispensation processing. In an exemplary embodiment, the non-flat surface forms part of sphere whose radius is equal to the maximum distance between the ideal contact point along the longitudinal axis A-A and the maximum expected contact point that may result from angular displacement of the control rod 72. As a result, the piston drive mechanism 34 of the pipette 30 virtually eliminates the unwanted longitudinal displacement of the control rod 72 increasing the accuracy in the volume of liquid aspirated or dispensed.

The external tip ejection mechanism 40 and the internal tip ejection mechanism 42 eject the tip 130 from the aspirating and dispensing end of the pipette 30 avoiding possible contamination of samples. The internal tip ejection mechanism 42 includes, but is not limited to, an ejection knob 140, a stationary cylinder 142, a knob cylinder 144, a body cylinder 146, a rod 148, an ejection spring 150, and a mounting brace 152. The stationary cylinder 142 mounts to the body case 32. The mounting brace 152 mounts to the body case 32 and/or the stationary cylinder 142. The stationary cylinder 142 and the mounting brace 152 remain fixed to the body case 32. The ejection knob 140 mounts to the knob cylinder 144. The ejection knob 140 may be rotatable about the longitudinal axis A-A thereby accommodating comfortable operation using either a left or a right hand of a user. The knob cylinder 144 slidably mounts to the stationary cylinder 142 to allow motion of the knob cylinder 144 in combination with depression of the ejection knob 140 to eject the tip 130. The body cylinder 146 mounts to the knob cylinder 144. The rod 148 mounts to an end of the body cylinder 146 opposite the knob cylinder 144. The ejection spring 150 mounts to the body cylinder 146 at a first end 156 and to the mounting brace 152 at a second end 158. Depression of the ejection knob 140 drives the rod 148 toward the tip 130. The ejection spring 150 causes the rod 148 to return in the opposite direction when the ejection knob 140 is released thereby moving the ejection knob 140 back into the original position. The rod 148 includes a notch 154 at a first end of the rod 148 opposite the body cylinder 146.

With reference to FIG. 3, the external tip ejection mechanism 40 includes, but is not limited to, an ejection blade 156 and an ejection blade adjustment knob 158. The ejection blade 156 has a curved shape that follows the external shape of the sampling tube 36. The ejection blade 156 has a first end 160 and a second end 162. An extension 157 extends from the first end 160 of the ejection blade 156. The extension 157 mounts to the notch 154 of the rod 148 thereby attaching the external tip ejection mechanism 40 to the internal tip ejection mechanism 42. The second end 162 comprises an enclosed cylinder that slides over the sampling tube 36. As a result, depression of the ejection knob 140 causes motion of the ejection blade 156 along the sampling tube 36 ejecting the tip 130 from the sampling tube 36 with the second end 162. Rotation of the ejection adjustment knob 158 mounted to the ejection blade 156 near the first end 160 causes the second end 162 of the ejection blade 156 to move up or down the sampling tube 36. Adjustment of the ejection blade 156 location along the sampling tube 36 allows the external tip ejection mechanism 40 to eject different size tips.

With reference to the exemplary embodiment of FIGS. 1, 2, 16, 17, and 21 the control electronics card 44 includes, but is not limited to, the display 170, a thumb wheel 172, a speed decrease button 174, a speed increase button 176, an inversion button 178, an aspirate/dispense button 180, a left operational mode button 182, a right operational mode button 184, a reset switch 186, an external power supply connector 188, and a communication interface 190. The control electronics card 44 additionally includes a microprocessor 300 and other associated electronics (not shown) including a memory 302 having stored thereon computer-executable instructions to control motion of the control rod 72 through the actuator 70 of the piston drive mechanism 34.

Figure 16:
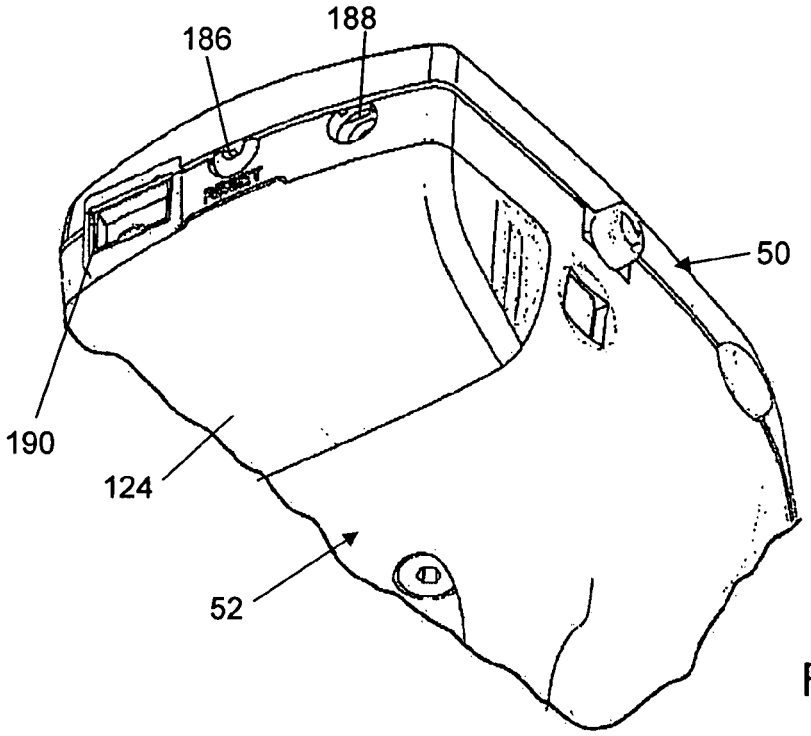
FIG. 16 is a second perspective view of the user controls of the electronic pipette in accordance with an exemplary embodiment.
Figure 17:
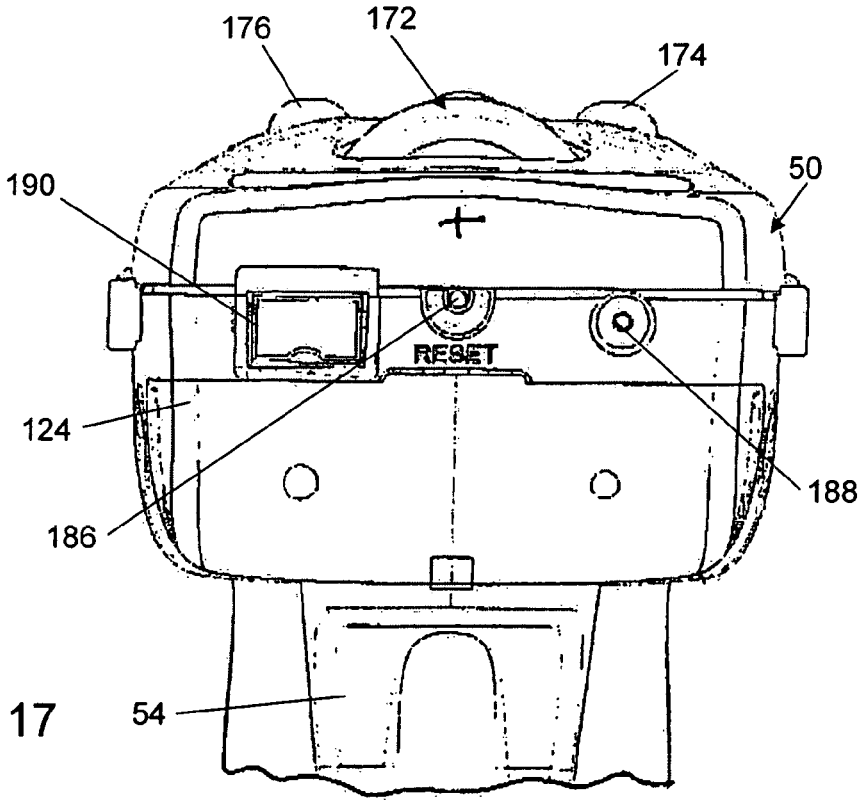
FIG. 17 is a top view of the user controls of the electronic pipette of FIG. 16 in accordance with an exemplary embodiment.

The display 170 presents information in a user interface to the user and allows the user to define the operational characteristics of the pipette. The display 170 may be, but is not limited to, a thin film transistor (TFT) display, a light emitting diode (LED) display, a Liquid Crystal Display (LCD), a Cathode Ray Tube (CRT) display, etc. With reference to FIGS. 16 and 17, the reset switch 186 may be located on the top of the body case 32 opposite the tip 130 for easy accessibility by the user without interrupting the operation of the pipette 30. The reset switch 186 may allow the user to reset the pipette 30 electronics if the microprocessor enters an unstable state. The external power supply connector 188 also may be located on the top of the body case 32 opposite the tip 130 for easy accessibility by the user without interrupting the operation of the pipette 30. The external power supply connector 188 may provide charging of the battery 120 and/or provide power for operation of, for example, the piston drive mechanism 34 and the control electronics card 44.

The speed decrease button 174 decreases the speed of the aspiration and/or dispensation of liquid into or out of the sampling tube 36. In an exemplary embodiment, the speed decrease button 174 decreases a pre-set speed setting in a range from one to five. In an alternative embodiment, the speed decrease button 174 directly decreases a speed value. The speed increase button 176 increases the speed of the aspiration and/or dispensation of liquid into or out of the sampling tube 36. In an exemplary embodiment, the speed increase button 176 increases a pre-set speed setting in a range from one to five. In an alternative embodiment, the speed increase button 176 directly increases the speed value.

Depressing the inversion button 178 causes the operation of the aspirate/dispense button 180 to invert from aspirate to dispense or from dispense to aspirate. In an exemplary embodiment, the inversion button 178 is enabled in only certain operational modes supported by the pipette 30 or during specific programs as defined by the user. Depressing the aspirate/dispense button 180 causes the aspiration, dispensation, and/or purge of liquid in the sampling tube 36. In an exemplary embodiment, successive depressions of the aspirate/dispense button 180 causes different results depending on the operational mode of the pipette 30.

Figure 20:
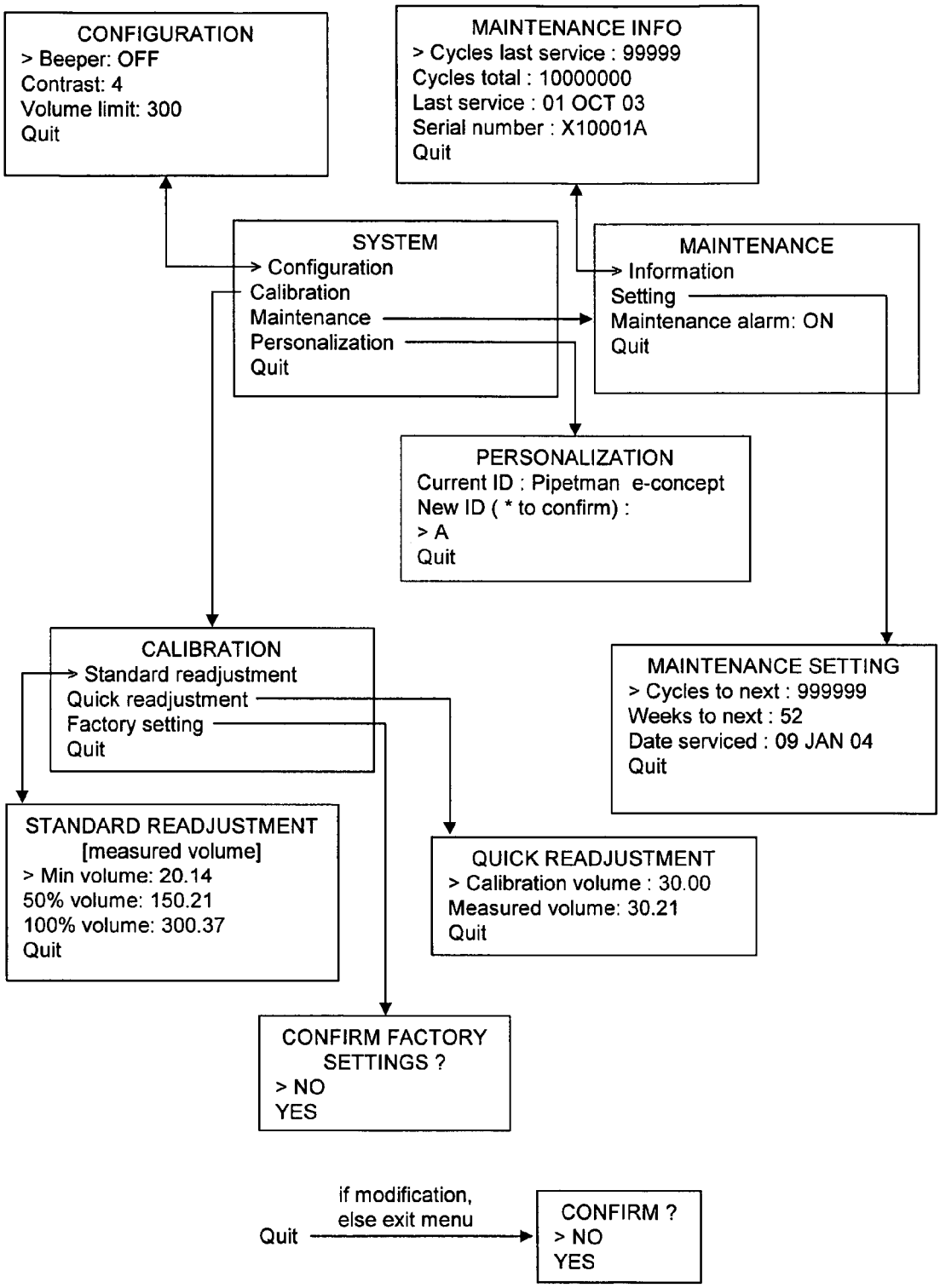
FIG. 20 is a block diagram of a plurality of menu items and a sequence of displays that may be presented in the display of the electronic pipette in accordance with an exemplary embodiment.

The left operational mode button 182 and the right operational mode button 184 may be located on either side of the pipette 30 to provide comfortable access by the user using either a left or a right hand. The left operational mode button 182 and the right operational mode button 184 provide the user with one or more operational mode of using the pipette 30. The user selects the desired operational mode through successive depression of either the left operational mode button 182 or the right operational mode button 184 or both. Example operational modes may include, but are not limited to "auto", "auto+mix", "manual", "repetitive", and "program". In the "auto" operational mode, for example, the user may define the volume to pipette without a limit to the number aspirations and/or dispensations of liquid. In an exemplary embodiment, simultaneous depression of both the left operational mode button 182 and the right operational mode button 184 may cause the display 170 to present a menu of selectable items. Example menu items and a sequence of display are shown in FIG. 20. The menu items may be displayed in a read only mode and in a read and write mode in an exemplary embodiment. The user may navigate between the plurality of items in the menus and select items to modify in the menu using the thumb wheel 172. Additionally, the user may set the items to various values using the thumb wheel 172.

In the "auto+mix" operational mode, for example, the user may define the volume to pipette and the volume of mixing. In the "manual" operational mode, for example, the user may use the pipette 30 like a manual pipette without use of the actuator 70 to control the volume of aspiration/dispensation. The user may aspirate or dispense only a part of a defined volume of liquid allowing aspiration or dispensation in one or more step. In the "repetitive" operational mode, for example, the user may define a volume to dispense. In a next step, the user may define the number of dispensation volumes. For example, using a 100 μL pipette, selecting a dispensation volume of 10 μL may allow up to 10 successive dispensations. The entire specified volume is aspirated after a first depression of the aspirate/dispense button 180 and successive depressions of the aspirate/dispense button 180 cause dispensation of the selected dispensation volume divided by the number of selected dispensation volumes. A subsequent depression of the aspirate/dispense button 180 causes a purge. A new cycle may be entered after a subsequent depression of the aspirate/dispense button 180. In the "program" operational mode, for example, the user may define a "program" for execution by the microprocessor. The program may be defined using an external computing device and received at the pipette 30 using a communication interface 190 discussed with reference to FIGS. 16-18.

The thumb wheel 172 enables menu navigation and parameter setting by providing three functions: parameter selection, a parameter increase, and a parameter decrease. Use of the thumb wheel 172 minimizes the number of buttons on the control electronics card 44 of the pipette 30 by replacing a validation button, an incrementing button, and a decrementing button. With reference to FIGS. 10-12, the thumb wheel 172 includes, but is not limited to, a disc ring 198, a disc support 200, a disc 202, an electronic circuit board 204, and an axle 206. The disc ring 198 mounts to the disc support 200. The user rotates the disc ring 198 that extends beyond the front case 50 of the body case 32. The disc ring 198 may be formed of a latex rubber in an exemplary embodiment. The disc support 200 mounts to the disc 202. The disc 202 mounts to the axle 206 about which the disc 202 rotates. The axle 206 mounts to the electronic circuit board 204 in a generally perpendicular direction from a first face of the electronic circuit board 204.

Both translational motion 210 and rotational motion 212 of the thumb wheel 172 are detected and relayed to the microprocessor of the control electronics card 44 through the electronic circuit board 204. In translational motion, all of the points of the moving body have at any instant the same velocity and direction of motion as opposed to rotational motion. In rotational motion, the body turns about an axis. Rotation in a plane involves rotation about an axis perpendicular to the plane of rotation. An optical motion encoder detects and converts motion information into a digital output. A quadrature encoder generally may be composed of a light source, an encoded disc, and a light detector. The encoder modulates a beam of light, whose intensity is sensed by the light detector, producing two signals, A and B as shown with reference to FIG. 13. Signal B lags signal A by 90 degrees. An encoder may measure either translation motion or rotational motion. Both types sense mechanical motion and convert the information (velocity, position, acceleration) into electrical signals that can be used to monitor the motion. The most common encoders are opto-mechanical, in which motion of a mechanical encoding unit, such as the encoded disc, interrupts the optical path between the light source and the light detector. For example, the encoded disc may include one or more slot in the surface of the disc. The light source may be a photodiode. The light detector may be a photodetector.

Figures 13, 14, 15:
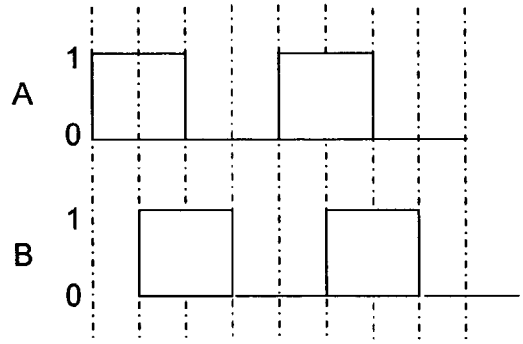
FIG. 13 is a diagram of signals used in operation of the thumb wheel of FIG. 11 in accordance with an exemplary embodiment.
FIG. 14 is a first table of signals resulting from a positive rotation of the thumb wheel of FIG. 11 in accordance with an exemplary embodiment.
FIG. 15 is a second table of signals resulting from a negative rotation of the thumb wheel of FIG. 11 in accordance with an exemplary embodiment.

The photodetector may be mounted to the electronics board 204, detect motion of the rotating disc 202 and transmit the rotational motion information to the electronic circuit board 204. In an exemplary embodiment, the photodetector is an infrared photodetector. As known to those skilled in the art, other detection means may be integrated with the thumb wheel 172 to detect rotational motion of the disc 202. The disc 202 and the electronic circuit board 204 may be arranged so that the rotation 212 of the disc 202 simultaneously generates the signal A and the signal B, for example as illustrated in FIG. 13. Each signal may be composed of a period of "two" on (1) and then of "two" off (0). FIG. 14 shows a table of successive values for each signal given a positive rotation of the thumb wheel 172. FIG. 15 shows a table of successive values for each signal given a negative rotation of the thumb wheel 172. Thus, given a previous value for each signal A and B and a current value for each signal A and B, the rotation direction of the thumb wheel 172 may be determined through comparison with the tables of FIG. 14 and FIG. 15. Thus, a previous signal A value of 1 and a previous signal B value of 1 and a current signal A value of 0 and a current signal B value of 1 indicates a positive rotation of the thumb wheel 172. Conversely, a previous signal A value of 1 and a previous signal B value of 1 and a current signal A value of 1 and a current signal B value of 0 indicates a negative rotation of the thumb wheel 172. Thus, the thumb wheel 172 may include an encoder 304 (shown with reference to FIG. 22) that uses quadrature encoding.

A motion detector 302 (shown with reference to FIG. 22) may be mounted to the electronic circuit board 204 to detect a translational motion 210 of the disc 202 produced when the user depresses the thumb wheel 172. For example, in an exemplary embodiment, the motion detector 302 may include a spring 208 that mounts to the axle 206 and causes the disc 202 to return to its original position after the user releases the thumb wheel 172. Movement of the spring 208 may create an "impulse" that is detected at the electronic circuit board 204. As known to those skilled in the art, other detection means may be integrated with the thumb wheel 172 to detect translational motion of the disc 202.

The pipette 30 may measure the rotational speed of the rotating disc 202 when it is moved by the user. The rotating disc 202 may be divided into a predetermined number of sections that correspond to an angular measure of the wheel. For example, four sections correspond to an angular measure of 90 degrees. Six sections correspond to an angular measure of 60 degrees. The number of section crossings by the rotating disc 202 while it is rotated by the user are counted. While rotating the rotating disc 202, the user may "feel" each section crossing. The microprocessor measures the period of time for the rotating disc 202 to complete some rotation distance thereby calculating a speed of rotation. For example, the time to complete two successive rotations may be used to calculate the speed of rotation. Based on the period of time measured, the microprocessor may change an increment size for a parameter currently being modified by the user. For example, if the period is less than fifteen milliseconds, the microprocessor may increment the parameter by 100. If the period is greater than fifteen milliseconds but less than twenty-five milliseconds, the microprocessor may increment the parameter by 10. If the period is greater than twenty-five milliseconds, the microprocessor may increment the parameter by 1. Thus, the faster the user rotates the thumb wheel 172, the faster the parameter being set by the user increases or decreases. Conversely, if the rotation of the thumb wheel 172 is slow, the microprocessor commands a slower variation of the parameter. The increment values and thresholds for changing the increment values may be modified.

Example functions performable using the thumb wheel 172 through information displayed to the user in the display 170 include, but are not limited to the following.

Setting the volume to aspirate or to dispense by depressing the thumb wheel 172 to unlock the volume setting, by rotating the thumb wheel 172 to set the volume, and by depressing the thumb wheel 172 to lock the volume setting.

Two volumes may be selected in the pipette operational mode of "auto+mix". The first volume is the volume to pipette and the second volume is the volume to mix. The volumes may be defined in succession.

In the pipette "repetitive" mode of operation, the volume to pipette is set. After setting the volume, the maximum number of aspirations or dispensations may be displayed to the user on the display 170. The number may be lowered by rotating the thumb wheel 172 and by depressing the thumb wheel 172 to select the number of aspirations or dispensations.

Navigating through a menu displayed in the display 170 by rotating the thumb wheel 172 to move the cursor up or down and by depressing the thumb wheel 172 to select the menu item.

Setting a name to personalize (name of the operator, name of the department, or any other information definable in 20 characters) the pipette 30 by rotating the thumb wheel 172 to locate a character and depressing the thumb wheel 172 to select the character. Characters, for example, may include letters from A to Z, numbers from 0 to 9, /, space and *. The symbol * may indicate that the last character has been selected by the user. Each character may be defined successively.

Setting a number of cycles, a number of weeks, or a date until a next servicing of the pipette 30 by rotating the thumb wheel 172 to define the parameter and by depressing the thumb wheel 172 to set the value. When the selected parameter is reached, a message may display on the display 170 to remind the user that servicing of the pipette is needed.

Entering adjustment values into the pipette 30 for a standard readjustment by entering in the pipette 30 the results of a gravimetric test at a minimum volume through depression of the thumb wheel 172 to enable the volume setting, through rotation of the thumb wheel 172 to set the volume, and through depression of the thumb wheel 172 to save the change, by entering in the pipette 30 the results of a gravimetric test at 50% of the volume through depression of the thumb wheel 172 to enable the volume setting, through rotation of the thumb wheel 172 to set the volume, and through depression of the thumb wheel 172 to save the change, and by entering in the pipette 30 the results of a gravimetric test at 100% of the volume through depression of the thumb wheel 172 to enable the volume setting, through rotation of the thumb wheel 172 to set the volume, and through depression of the thumb wheel 172 to save the change.

Entering quick readjustment values into the pipette 30 for a standard readjustment by entering in the pipette 30 a volume for the quick adjustment through depression of the thumb wheel 172 to enable the volume setting, through rotation of the thumb wheel 172 to set the volume, and through depression of the thumb wheel 172 to save the change, and by entering in the pipette 30 the results of a gravimetric test at the selected volume through depression of the thumb wheel 172 to enable the volume setting, through rotation of the thumb wheel 172 to set the volume, and through depression of the thumb wheel 172 to save the change.

Activating and deactivating a beeper by depressing the thumb wheel 172 to unlock the setting of the function, by rotating the thumb wheel 172 to select the function, and by depressing the thumb wheel 172 to lock the selection.

Setting a contrast and/or a maximum volume to aspirate or to dispense by depressing the thumb wheel 172 to unlock the parameter setting, by rotating the thumb wheel 172 to select the parameter, and by depressing the thumb wheel 172 to lock the parameter setting.

Validating a change to a parameter of the pipette 30 after setting certain values and before quitting the menu by rotating the thumb wheel 172 to YES or NO and by depressing the thumb wheel 172 to select the answer.

Selecting a response to a message informing the user that a servicing should be performed by rotating the thumb wheel 172 to enter the servicing menu or to set a reminder later and by depressing the thumb wheel 172 to select the action.

Figure 18:
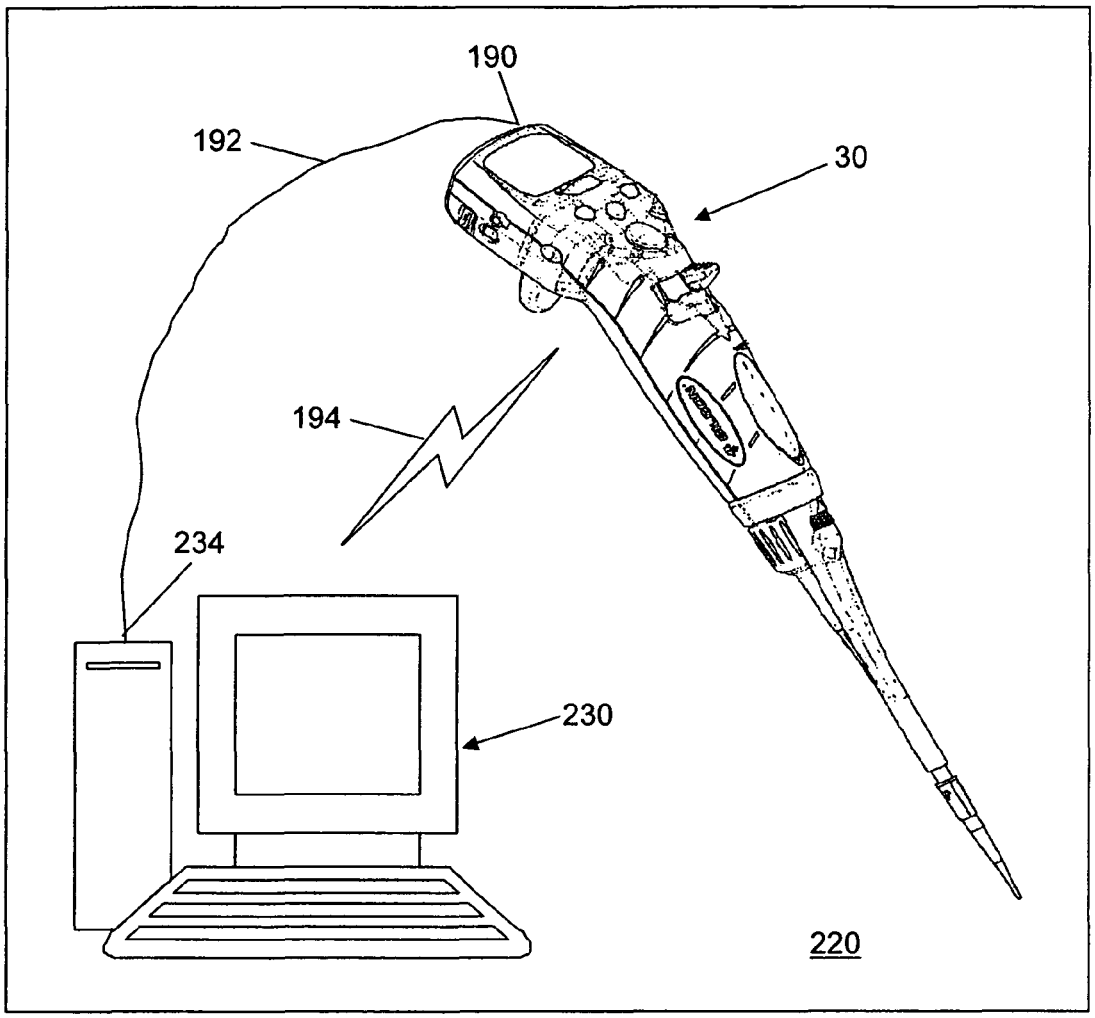
FIG. 18 is a diagram of a system using the electronic pipette of FIG. 1 in accordance with alternative exemplary embodiments.

As shown with reference to FIG. 18, a system 220 may include, but is not limited to, the pipette 30 and a computing device 230. The communication interface 190 allows the pipette 30 to communicate with the computing device 230. The computing device 230 may be a computer of any form factor including desktop, laptop, personal data assistant, etc. The computing device 230 is physically distinct from the pipette 30. The communication interface 190 may be located on the top of the body case 32 opposite the tip 130 for easy accessibility by the user without interrupting the operation of the pipette 30 as shown with reference to FIGS. 16 and 17. Communication between the pipette 30 and the computing device 230 may use various transmission technologies including, but not limited to, Code Division Multiple Access (CDMA), Global System for Mobile Communications (GSM), Universal Mobile Telecommunications System (UMTS), Time Division Multiple Access (TDMA), Transmission Control Protocol/Internet Protocol (TCP/IP), Short Messaging Service (SMS), Multimedia Messaging Service (MMS), e-mail, Instant Messaging Service (IMS), Bluetooth, IEEE 802.11, etc. The pipette 30 and the computing device 230 may communicate using various media including, but not limited to, radio, infrared, laser, cable connection, etc. Thus, the communication interface 190 may utilize a wired connection 192 and/or a wireless connection 194.

The wired connection 192 may include a first end that connects with the communication interface 190 of the pipette 30 and a second end that connects with a communication interface 234 of the computing device 230. In an exemplary embodiment, the communication interface 190 of the pipette 30 meets the Institute of Electrical and Electronics Engineers (IEEE) 1394 mini standards. In an exemplary embodiment, the communication interface 234 of the computing device 230 may be of type RS 232 that is designed to accept a Universal Serial Bus connector. In an alternative embodiment, the communication interface 190 of the pipette 30 and/or the communication interface 234 of the computing device 230 may be an Ethernet interface.

Wireless communication interfaces may connect devices over various distances from short to long. The pipette 30 and the computing device 230 may support processing for broadcasting and receiving a wireless signal. The wireless signals may, for example, use the IEEE 802.11 ™ standard, using either version 802.11a, 802.11b, 802.11 f or 802.11 g. Additionally, the wireless signals may, for example, use the BLUETOOTH standard of which IEEE 802.15.1 is the most recent version. The IEEE 802.11 ™ specifications define wireless standards for Wireless Local Area Networks (WLANs) that provide an "over-the-air" interface between a wireless client and a base station or access point, as well as among other wireless clients. The IEEE 802.15 Working Group provides standards for low-complexity and low-power consumption Wireless Personal Area Networks (PANs) such as those supported by the Bluetooth specification.

Figure 19:
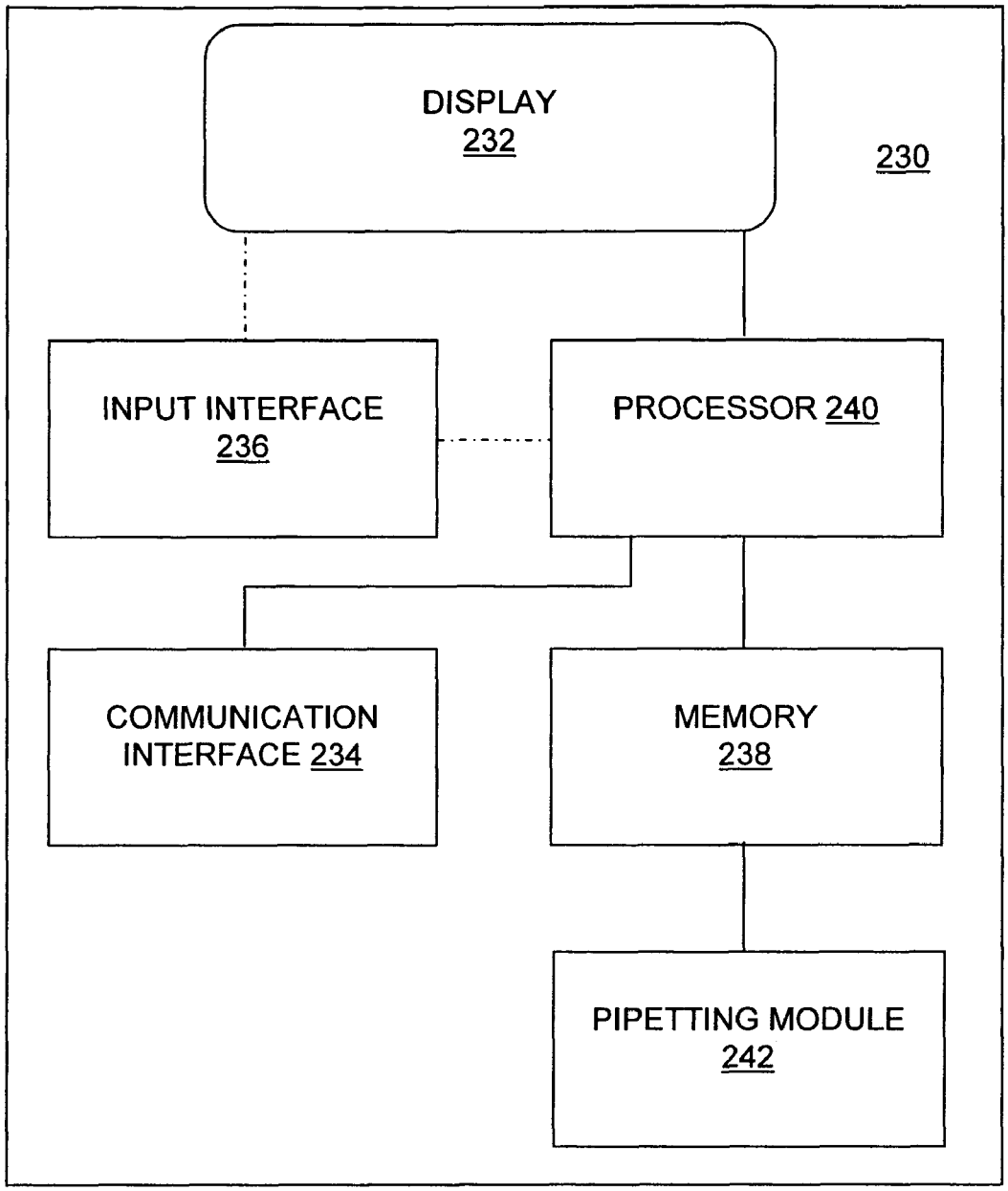
FIG. 19 is a diagram of a computing device capable of communicating with the electronic pipette in accordance with an exemplary embodiment.

With reference to the exemplary embodiment of FIG. 19, the computing device 230 may include, but is not limited to, a display 232, the communication interface 234, an input interface 236, a memory 238, a processor 240, and a pipetting module 242. The display 232 presents information to the user of the computing device 230 and allows the user to define the operational characteristics of the pipette 30 using the larger display and input interface 236 of the computing device 230 instead of those provided at control electronics card 44. The display 232 may be, but is not limited to, a TFT display, an LED display, an LCD, a CRT display, etc. The input interface 236 provides an interface for receiving information from the user for entry into the computing device 230. The input interface 236 may use various input technologies including, but not limited to, a keyboard, a pen and touch screen, a mouse, a track ball, a touch screen, a keypad, one or more buttons, etc. to allow the user to enter information into the computing device 230 or to make selections. The input interface 236 may provide both an input and output interface. For example, a touch screen both allows user input and presents output to the user.

The memory 238 may be the electronic holding place for an operating system of the computing device 230 and/or the pipetting module 242 so that the information can be reached quickly by the processor 240. The computing device 230 may have a plurality of memories 238 using different memory technologies including, but not limited to, Random Access Memory (RAM), Read Only Memory (ROM), flash memory, etc.

The processor 240 executes instructions that cause the computing device 230 to perform various functions. The instructions may be written using one or more programming language, scripting language, assembly language, etc. Additionally, the instructions may be carried out by a special purpose computer, logic circuits, or hardware circuits. Thus, the processor 240 may be implemented in hardware, firmware, software, or any combination of these methods. The term "execution" refers to the process of running an application, program, or module or the carrying out of the operation called for by an instruction. The processor 240 executes a module meaning that it performs the operations called for by that module in the form of a series of instructions. The processor 240 may retrieve an application from a non-volatile memory that is generally some form of ROM or flash memory and may copy the instructions in an executable form to a temporary memory that is generally some form of RAM. The processor 240 may execute instructions embodied, for example, in the pipetting module 242. The computing device 200 may include one or more processor 240.

The pipetting module 242 is an organized set of instructions that, when executed, allow the user to create a program for execution by the pipette 30. The program defines operations for the pipette 30 to perform. The pipetting module 242 may be written using one or more programming language, assembly language, scripting language, etc. The term "execution" is the process of carrying out the instructions called for by the pipetting module 242. For the pipetting module 242 to execute, the application may be translated into a machine language that the computing device 230 understands. Launching the pipetting module 242 generally entails retrieving the pipetting module 242 in an executable form from a permanent memory device and copying the executable to a temporary memory device, generally some form of RAM. The permanent memory device may be, but is not limited to, a hard disk, a floppy disk, a CD-ROM, etc.

The pipette 30 may transmit to and receive information from the computing device 230. Selection of the operational mode "program" causes the pipette 30 to execute a program module defined by the user on the computing device 230 using the pipetting module 242 and transmitted to the pipette 30 through the communication interface 234. The pipetting module 242 transmits the program module to the pipette 30 using the communication interface 234. The pipette 30 receives the program module using the communication interface 190. The program module includes the operations to be executed by the microprocessor of the pipette 30 after the user places the pipette 30 in the "program" operational mode. For example, the program module may be a table of instructions to the pipette 30. As another alternative, the program module may include a word or letter followed by a parameter value. A communication language may be developed for defining the operations to be executed by the pipette 30. The communication language may be similar to those that employ tags such as the hypertext markup language or the extensible markup language. To execute the program module that comprises the operational instructions to the pipette, the pipette 30 is placed into the program mode using the left operational mode button 182 or the right operational mode button 184.

The pipetting module 242 of the computing device 230 allows the user to easily create complex pipetting operations using the display 232 and the input interface 236 of the computing device 230 instead of the interface components of the pipette 30 described with reference to FIGS. 1, 2, and 10. For example, the pipetting module 242 provides functions that include, but are not limited to:

- Updating installed software on the pipette 30. For example, a new version of the software may be sent to the user using a CD or DVD, by Internet, etc. and the user may install the new version of the software on the pipette 30 from the computing device 230.
- Entering a serial number into the pipette 30. A serial number may be entered into the pipette 30 after manufacture and also engraved into the body case 32 of the pipette.
- Calibrating the pipette 30 during production of the pipette 30. Several sample volumes of liquid are aspirated into the pipette 30, dispensed from the pipette 30, and measured. The measured values are entered into the pipette 30.
- Automating, for example, six production stages required after assembly of the pipette 30 including
  - storing pipette data that indicates the pipette type, for example, monocanal pipette, eight- or twelve-canal pipette, nominal pipette volume, etc.,
  - storing gravimeter data to calibrate the pipette 30 as indicated above,
  - converting a weight to volume and calculating a mean, a standard deviation, etc.,
  - adding volume values to the pipette 30,
  - updating stored gravimeter data used to calibrate the pipette 30 as indicated above, and
  - storing the serial number as indicated above.

Transferring data from the pipette to the computing device 230 for analysis and for modification and subsequent restore to the pipette 30 from the computing device 230. Example data may include, but is not limited to, the serial number, a pipette identification and version number, a number of pipette operations to be applied before reaching a nominal total quantity of pipette operations by the pipette 30, a number of pipette operations applied since the last servicing operation, a number of pipette operations executed since the pipette 30 left the factory, the last maintenance date, calibration data relative to the target volume and the volume actually measured, and calibration parameters including a volume measured at a minimum volume, a volume measured at a 50% of maximum volume, and a volume measured at a 100% of maximum volume.

Defining user programs for execution by the pipette in the operational mode "program". The user may define a custom program by selecting and organizing elementary tasks to create a program module that is communicated to the pipette 30 through the communication interface 190. The user defines the custom program using computing device 230. These tasks, in general, have customization parameters. Example tasks and customization parameters are defined below.

Air aspiration. A sequence of air intake volumes through the pipette 30 are defined. During this procedure, the pipetting module 242 displays on display 232 a name, a value of the volume of air to aspirate, and a speed of aspiration. In an exemplary embodiment, the user may specify a speed from among a predetermined number of available speeds defined by default for the pipette 30. For example, five speeds may be defined by default. The name may be defined by the user to describe the task and may, for example, have a maximum length of fifteen characters. By default, the name of the task may be "air aspiration" or "air gap".

Alarm. A number of beeps may be emitted by a sound generator of the pipette 30 even if the sound generator is deactivated by the user to notify the user of a specific point in the operation. For example, two beeps with an interval of about 500 milliseconds may be emitted.

Aspiration. The user may specify the following parameters: the volume to be aspirated, the speed of aspiration for this volume, and the name of the task. By default, the name of the task may be "aspiration" or "aspirate".

Dilution. The user may specify the following parameters: the volume of aspirated air or the air gap between each liquid sample, the volume of each liquid to aspirate, the aspiration speed of each liquid, a name of each of the two to five liquids intended to be displayed in the display 170 of the pipette 30, and the name of the task. In the absence of the name of each of the two to five liquids, the aspiration volume may be displayed.

Dispensation. The user may specify the following parameters: the volume to be dispensed, the speed of dispensation for this volume, and the name of the task. By default, the name of the task may be "dispensation" or "dispense".

Manual. Using the "aspiration" and "dispensation" tasks, depressing the aspirate/dispense button 180 aspirates or dispenses the full volume. Using the manual task, aspiration or dispensation occur only when pressure on the aspirate/dispense button 180 is maintained by the user. Aspiration or dispensation of the defined volume can therefore take place in several steps. A name of the task may be defined that is displayed in the display 170 of the pipette. Several types of manual tasks may be defined:

Manual mode type in which the volume of liquid and the speed of aspiration are defined and use of the inversion button 178 allows a change in direction of operation.

Manual aspiration-only type in which the aspiration volume, the speed of aspiration, and the speed of dispensation are defined and use of the inversion button 178 allows the procedure to be terminated.

Manual dispensation-only type in which the dispensation volume and the speed of dispensation are defined and use of the inversion button 178 allows the procedure to be terminated.

Mix. A mixing procedure involves a liquid that is aspirated and dispensed a predetermined number of times to mix the sample. The user may specify the following parameters: a mixture volume, a speed of aspiration, a speed of dispensation, a number of mixing cycles to be executed, for example, between 1 and 99 inclusive, and the name of the task. By default, the name of the task may be "mix" or "mixing". After the number of cycles is executed, the pipette 30 waits for the aspirate/dispense button 180 to be released to stop the mixing cycle.

Normal. Selection of the normal task sends an instruction to the pipette 30 to switch from a programmed task to a standard pipetting mode after user depression of the inversion button 178.

Pause. Selection of a pause task stops the progress of a mode or the programmed task for a time defined by the user. The user may specify the following parameters: the time and the name of the task. The time may, for example, be definable between 0 and 999.9 seconds with an increment of 0.1 seconds.

Purge. Selection of a purge task causes motion of the piston to insure that all of the liquid is removed from the sampling tube 36. The user may specify the name of the task. There may be multiple types of purge.

Repeat aspirations. The task executes a predetermined number of aspirations with each aspiration having an aspiration volume and a speed of aspiration. After each aspiration, a pause may be defined for either a period of time or until the aspirate/dispense button 180 is depressed. The user may specify the following parameters: a number of aspirations, a volume to be aspirated for each aspiration, a speed of aspiration for each volume to be aspirated, a name for each volume to be aspirated, a type of pause that follows the aspiration of each volume, and the name of the task.

Repeat Dispensations. The task executes a predetermined number of dispensations with each dispensation having a dispensation volume and a speed of dispensation. After each dispensation, a pause may be defined for either a period of time or until the aspirate/dispense button 180 is depressed. The user may specify the following parameters: a number of dispensations, a volume to be dispensed for each dispensation, a speed of dispensation for each volume to be dispensed, a name for each volume to be dispensed, a type of pause that follows the dispensation of each volume, and the name of the task.

Reverse. Selection of the reverse task inverts the operation of the pipette. During normal operation, aspiration of the liquid occurs until the desired volume is aspirated, dispensation of the liquid causes expulsion of this volume followed by an additional purge to insure that all of the liquid is dispnsed. Conversely, in the reverse mode, the desired volume and an additional volume are aspirated. Without stopping, the aspiration is followed by a dispensation of half of the additional volume. Depressing the aspirate/dispense button 180 again causes the dispensation of a quantity of liquid equal to the desired volume without dispensing the additional half of the additional volume remaining in the sampling tube 36. The remaining additional volume is dispensed during the purge.

Wait. Selection of a wait task stops the progress of a task for the entire time that the user depresses the aspirate/dispense button 180 or for the entire time until the user depresses the aspirate/dispense button 180.

Integrating new modes into the pipette 30.

Calibrating the pipette by the user. The user measures volumes effectively removed by providing three target volumes for the pipette 30, for example, a minimum volume, a volume at 50% of a maximum volume, and a volume at 100% of the maximum volume. The pipette may self-calibrate after the user transmits the value of the volumes measured for the respective samplings by the pipette 30. The pipetting module 242 executes one or more equations corresponding to the respective volumes. While the pipette 30 is in use, each equation allows the microprocessor of the pipette 30 to calculate a corrected value for the volume. The corrected value is displayed in the display 170 while the pipette is in use by the user. In fact, manual adjustment of the value to be aspirated involves transmission of a raw value to the microprocessor that applies the corresponding equation or matrix to obtain the corrected value.

Calibrating using a single-point. The user may calibrate the pipette 30 using a volume that the user frequently uses. The user specifies the volume and executes the aspiration and dispensation. The pipette 30 may self-calibrate in the manner related above.

Maintaining service information. The following parameters may be read from the pipette 30: a last servicing date, a total number of samplings executed, a number of pipette operations since the last servicing, a volume limit value, if a volume limit lower than the nominal pipette volume has been defined, values used for calibration, and values used for single-point calibration. The following parameters may be written to the pipette 30: a next servicing date, the volume limit value, the values used for calibration, and the values used for single-point calibration.

In alternative embodiments, additional, fewer, or different operations may be definable using the pipetting module 242. For example, when specifying the "auto" operational mode in the program module, the user may additionally select among various aspirate/dispense/purge options. For example, in an exemplary embodiment, the user may select from three aspirate/dispense/purge options. In a first option, the pipette stops after dispensing the liquid and before purging. In a second option, the pipette dispenses the liquid and purges without stopping. In a third option, the pipette is operated in a classic manner wherein liquid is aspirated after a first depression of the aspirate/dispense button 180, liquid is dispensed after a second depression of the aspirate/dispense button 180 without releasing the aspirate/dispense button 180, and liquid is purged after a release of the aspirate/dispense button 180 and a third depression of the aspirate/dispense button 180.

It is understood that the invention is not confined to the particular embodiments set forth herein as illustrative, but embraces all such modifications, combinations, and permutations as come within the scope of the following claims. Those skilled in the art will recognize that the system and methods of the present invention may be advantageously operated on different platforms using different operating systems including but not limited to, a Microsoft® Windows based operating system, a Macintosh® operating system, LINUX based operating system, a UNIX® based operating system, etc. Additionally, the functionality described may be distributed among modules that differ in number and distribution of functionality from those described herein without deviating from the spirit of the invention. Additionally, the order of execution of the modules may be changed without deviating from the spirit of the invention. Thus, the description of the preferred embodiments is for purposes of illustration and not limitation.

What is claimed is:

1. A device for aspirating and for dispensing liquid, the device comprising:

a sampling tube;

a piston assembly, the piston assembly mounted to the sampling tube and comprising a piston rod that fits within the sampling tube;

a piston drive mechanism, the piston drive mechanism comprising a control rod having a surface that contacts the piston assembly, the piston drive mechanism configured to move the piston rod of the piston assembly within the sampling tube thereby causing regulation of a liquid in the sampling tube;

a speed increase button;

a speed decrease button;

an aspirate/dispense button configured to cause aspiration or dispensation of liquid within the sampling tube when depressed;

an inversion button configured to cause, when depressed, operation of the aspirate/dispense button to invert from aspirate to dispense, or from dispense to aspirate;

a wireless communication interface, the wireless communication interface configured to receive electronic signals from a computing device that is not integral with the device;

a memory;

computer-executable instructions stored on the memory;

a microprocessor coupled to the wireless communication interface and operatively connected to the piston drive mechanism, the speed increase button, the speed decrease button, the aspirate/dispense button, and the inversion button, wherein the microprocessor is configured to process the received electronic signals and to: control movement of the control rod responsive to the speed increase button to increase a speed selected to regulate the liquid, control movement of the control rod responsive to the speed decrease button to decrease a speed selected to regulate the liquid, and control movement of the control rod responsive to the aspirate/dispense button to cause the device to aspirate or dispense liquid;

a first operational mode button operatively connected to the microprocessor and configured to allow selection of one of a plurality of modes for operating the device;

a second operational mode button operatively connected to the microprocessor and configured to allow selection of one of the plurality of modes for operating the device; and a display, wherein simultaneous depression of the first operational mode button and the second operational mode button causes the display to present a menu, wherein the computer-executable instructions stored on the memory comprise instructions for each of the plurality of modes for operating the device, wherein one of the plurality of modes for operating the device is a program operational mode, and wherein, when the program operational mode is selected, the microprocessor executes stored computer-executable instructions and thereby causes the device to perform a sequence of pipette operations that have been organized on and communicated from the computing device not integral with the device.

2. The device of claim 1, wherein the communication interface is configured to send electronic signals to the user-computing device.

3. The device of claim 1, wherein the wireless communication interface is selected from the group consisting of an IEEE 802.11 interface and a Bluetooth interface.

4. The device of claim 1, wherein the received electronic signals comprise an instruction configured to cause performance of an operation selected from the group consisting of a serial number entry operation, a calibration operation, a production automation operation, a data transfer operation, an execute program operation, a new mode integration operation, and a servicing operation.

5. The device of claim 1, wherein the surface of the control rod is a non-flat surface.

6. The device of claim 5, wherein the non-flat surface is spherical in shape.

7. The device of claim 1 further comprising a thumb wheel, the thumb wheel comprising:

an axle;

a disc mounted to the axle in a manner allowing rotation of the disc about the axle in a plane of the device, the disc translatable in the plane of the device;

an encoder configured to generate a first signal to indicate a rotation of the disc about the axle; and a motion detector configured to generate a second signal to indicate a translation of the disc in the plane of the device;

wherein the microprocessor is configured to receive the first signal and the second signal and to determine a user selection based on the received first signal and the received second signal.

8. The device of claim 7, wherein translation and rotation of the disc allows a user to make selections from the menu presented in the display.

9. The device of claim 8, wherein the menu allows the user to select a volume of liquid to regulate in the sampling tube.

10. The device of claim 7, wherein translation and rotation of the disc allows a user to set a parameter to a value presented in the display.

11. The device of claim 10, wherein the parameter is selected from the group consisting of a name, a number of cycles, a number of weeks, a date, an adjustment value, a quick readjustment value, a contrast, and a volume.

12. The device of claim 7, wherein the surface of the control rod is a non-flat surface.

13. The device of claim 1, wherein the received electronic signals comprise an instruction and further wherein the memory is further configured to store the instruction.

14. The device of claim 2, wherein the sent electronic signals comprise pipette data.

15. The device of claim 14, wherein the pipette data is selected from the group consisting of a device identification, a serial number, a version number, a date, a number of operations, a number of samplings, a target volume, a volume actually measured, a maximum volume, a minimum volume, a volume at 50% of the maximum volume, a volume limit, and a calibration parameter.

16. The device of claim 1, wherein the plurality of modes include an auto mode, an auto+mix mode, a manual mode, a repetitive mode, and the program operational mode.

17. The device of claim 1, further comprising a reset switch configured to cause a reset of the microprocessor.

* * * * *